US009567655B2

(12) United States Patent
Kerns et al.

(10) Patent No.: US 9,567,655 B2
(45) Date of Patent: Feb. 14, 2017

(54) PROCESSES FOR THE SEPARATION OF ORES

(71) Applicant: Georgia-Pacific Chemicals LLC, Atlanta, GA (US)

(72) Inventors: Michael S. Kerns, Wichita, KS (US); Pablo G. Dopico, The Woodlands, TX (US); John B. Hines, Atlanta, GA (US)

(73) Assignee: Georgia-Pacific Chemicals LLC, Atlanta, GA (US)

( * ) Notice: Subject to any disclaimer, the term of this patent is extended or adjusted under 35 U.S.C. 154(b) by 483 days.

(21) Appl. No.: 14/056,498

(22) Filed: Oct. 17, 2013

(65) Prior Publication Data

US 2014/0110621 A1 Apr. 24, 2014

Related U.S. Application Data

(60) Provisional application No. 61/716,775, filed on Oct. 22, 2012.

(51) Int. Cl.

| | |
|---|---|
| ***B03D 1/02*** | (2006.01) |
| ***B03D 1/016*** | (2006.01) |
| ***B03D 1/18*** | (2006.01) |
| ***C22B 3/00*** | (2006.01) |
| ***B03D 1/002*** | (2006.01) |
| ***B03D 1/018*** | (2006.01) |
| *B03D 1/004* | (2006.01) |
| *B03D 1/008* | (2006.01) |

(52) U.S. Cl.

CPC ..... *C22B 3/00* (2013.01); *B03D 1/002* (2013.01); *B03D 1/016* (2013.01); *B03D 1/018* (2013.01); *B03D 1/02* (2013.01); *B03D 1/021* (2013.01); *B03D 1/008* (2013.01); *B03D 1/0046* (2013.01); *B03D 2201/005* (2013.01); *B03D 2201/06* (2013.01); *B03D 2203/02* (2013.01); *B03D 2203/06* (2013.01)

(58) Field of Classification Search

None

See application file for complete search history.

(56) References Cited

U.S. PATENT DOCUMENTS

| | | | | |
|---|---|---|---|---|
| 4,904,375 | A * | 2/1990 | Snow | B03D 1/002 209/166 |
| 9,403,703 | B2 * | 8/2016 | Swift | C02F 1/56 |
| 2006/0151360 | A1 * | 7/2006 | Wright | B01D 21/0012 209/166 |
| 2010/0294725 | A1 | 11/2010 | Bush et al. | |

FOREIGN PATENT DOCUMENTS

| | | | |
|---|---|---|---|
| WO | 2009/149334 | A3 | 12/2009 |

OTHER PUBLICATIONS

Liu Cheng et al., "Application Handbook of Surfactants", Chemical Industry Press, Sep. 2004, p. 873.

Jiang Qingzhe et al., "Surfactant Science and Application". China Petrochemical Press, May 2006, p. 211.

Huang Bo edited, "Coal Flotation Technique", Metallurgical Industry Press, Mar. 2012, pp. 21-22.

* cited by examiner

*Primary Examiner* — Thomas M Lithgow

(74) *Attorney, Agent, or Firm* — Ram W. Sabnis

(57) ABSTRACT

Methods for purifying one or more value materials are provided. The method can include contacting an aqueous mixture comprising a value material and a contaminant with a dispersant and a depressant to produce a treated mixture. A weight ratio of the dispersant to the depressant can be from about 1:1 to about 30:1. The method can also include recovering a purified product comprising the value material from the treated mixture. The purified product can have a reduced concentration of the contaminant relative to the aqueous slurry.

20 Claims, No Drawings

PROCESSES FOR THE SEPARATION OF ORES

CROSS-REFERENCE TO RELATED APPLICATION

This application claims priority to U.S. Provisional Patent Application having Ser. No. 61/716,775, filed Oct. 22, 2012, which is incorporated by reference herein.

BACKGROUND

Field

Embodiments described herein generally relate separation of ores into a purified ore and gangue. More particularly, such embodiments relate to depressant/dispersant compositions and methods for using same to aid in the separation of the ores.

Description of the Related Art

Flotation, e.g., froth flotation and reverse froth flotation, coagulation, flocculation, filtration, and sedimentation, are widely used separation processes for the beneficiation of ores and other solids present as a component in a liquid suspension, dispersion, solution, slurry, or other mixture. The separation is accomplished based on differences in the tendency of various materials to associate with rising gas (usually air) bubbles. Various additives are commonly incorporated into the flotation liquid to improve the selectivity of the separation process. For example, substances identified as "collectors" can be used to chemically and/or physically absorb preferentially onto one of the substances in the liquid mixture to render it more hydrophobic and more amenable to flotation. Conversely, "depressants" are often used in conjunction with collectors, to render other materials in the mixture, e.g., gangue, less likely to associate with the air bubbles, and therefore less likely to be carried into the froth concentrate and more likely to remain in the underflow or tailings.

Various dispersants, depressants, or dewatering agents for improving flotation separations are known in the art and include guar gum, sodium silicate, starch, tannins, dextrins, lignosulphonic acids, carboxymethyl cellulose, cyanide salts and others. Because different substances in suspension, dispersion, or slurry are affected differently by the "collector" and/or the "depressant," a degree of separation is obtained by this process. Despite the large offering of dispersants, depressants, or dewatering agents known in the art, an adequate degree of refinement in many cases remains difficult to achieve, even, in the case of froth flotation, when one or more flotations are employed.

There is a need, therefore, for improved compositions for use in separation processes such as froth flotation and the separation of solid contaminants from liquid mixtures.

SUMMARY

Methods for purifying one or more value materials are provided. In at least one specific embodiment, the method can include contacting an aqueous mixture comprising a value material and a contaminant with a dispersant and a depressant to produce a treated mixture. A weight ratio of the dispersant to the depressant can be from about 1:1 to about 30:1. The dispersant can include silica, a silicate, a polysiloxane, a starch, a modified starch, a gum, a tannin, a lignosulphonate, carboxyl methyl cellulose, a cyanide salt, a polyacrylic acid based polymer, a naphthalene sulfonate, a benzene sulfonate, a pyrophosphate, a phosphate, a phosphonate, a tannate, a polycarboxylate polymer, a polysaccharide, dextrin, a sulfate, or any mixture thereof. The depressant can include an amine-aldehyde resin, an amine-aldehyde resin modified with a silane coupling agent, a Maillard reaction product, a mixture of one or more polysaccharides and one or more resins having azetidinium functional groups, a polysaccharide cross-linked with one or more resins having azetidinium functional groups, or any mixture thereof. The method can also include recovering a purified product comprising the value material from the treated mixture. The purified product can have a reduced concentration of the contaminant relative to the aqueous slurry.

In at least one other specific embodiment, the method for purifying a value material can include combining a dispersant and a depressant with an aqueous mixture comprising a value material and a contaminant to produce a treated mixture. A weight ratio of the dispersant to the depressant can be from about 1:1 to about 30:1. The dispersant can include a silicate. The depressant can include an amine-aldehyde resin. The method can also include passing air through the treated mixture. A relatively hydrophobic fraction can float to the surface and a relatively hydrophilic fraction can sink to the bottom. The method can also include recovering a purified product comprising the value material from the relatively hydrophobic fraction or the relatively hydrophilic fraction. The purified product can have a reduced concentration of the contaminant relative to the aqueous slurry.

In at least one specific embodiment, a composition can include a dispersant and a depressant. A weight ratio of the dispersant to the depressant can be from about 1:1 to about 30:1. The dispersant can include silica, a silicate, a polysiloxane, a starch, a modified starch, a gum, a tannin, a lignosulphonate, carboxyl methyl cellulose, a cyanide salt, a polyacrylic acid based polymer, a naphthalene sulfonate, a benzene sulfonate, a pyrophosphate, a phosphate, a phosphonate, a tannate, a polycarboxylate polymer, a polysaccharide, dextrin, a sulfate, or any mixture thereof. The depressant can include an amine-aldehyde resin, an amine-aldehyde resin modified with a silane coupling agent, a Maillard reaction product, a mixture of one or more polysaccharides and one or more resins having azetidinium functional groups, a polysaccharide cross-linked with one or more resins having azetidinium functional groups, or any mixture thereof.

DETAILED DESCRIPTION

Mixtures containing one or more ores and/or other value material and one or more impurities, contaminants, or gangue in the form of a suspension, dispersion, solution, or slurry can be separated via flotation, e.g., froth flotation and reverse froth flotation, coagulation, flocculation, filtration, and/or sedimentation to provide a beneficiated or purified ore having a reduced concentration of the one or more impurities relative to the mixture. The ore and/or other value material and the one or more contaminants can be combined with any suitable liquid medium to form the suspension, dispersion, solution, or slurry. Illustrative liquid mediums can include, but are not limited to, water, brines, or mixtures thereof. In at least one example, the mixture can be an aqueous mixture.

It has been surprisingly and unexpectedly discovered that treating the liquid mixture containing the ore(s) and/or other value material and the contaminant(s) with a combination of a dispersant and a depressant can significantly increase the efficiency and productivity of the separation process. It has also surprisingly and unexpectedly been discovered that a significant reduction in the total amount of dispersant required to achieve the same degree of separation efficiency can be achieved with the addition of the one or more depressants. Furthermore, when the one or more depressants is used in combination with the dispersant in a froth flotation separation process, the quality of the froth or bubbles is improved, thus facilitating improved separation of the froth. In addition to treating the liquid mixture with the depressant and the dispersant, the liquid mixture can also be treated with one or more collectors.

The depressant and the dispersant and, if present, the collector can be mixed, blended, contacted, or otherwise combined with one another to form or produce the treated mixture. Depending, at least in part, on the particular ore and/or contaminant present in the mixture, the depressant can have a greater effect in facilitating the separation of the contaminant or the ore. Without wishing to be bound by theory, it is believed that the dispersant can cause the particulates or solids, i.e., the ore(s) and/or other value material and/or the one or more contaminants, to separate or dissociate throughout the mixture. By separating the particulates within the mixture it is believed that the depressant and, if present, the collector can more readily interact with the contaminants and/or the ore or other value material to facilitate the separation of thereof.

The depressant, dispersant, and, if present, collector can be combined with the liquid mixture in any order or sequence with respect to one another. For example, the dispersant can be combined with the liquid mixture to form a first mixture, the depressant can be combined with the first mixture to form a second mixture, and the collector, if present, can be combined with the second mixture to form the treated mixture. In another example, the dispersant can be combined with the liquid mixture to form the first mixture, the collector can be present and combined with the first mixture to form the second mixture, and the depressant can be combined with the second mixture to form the treated mixture. In another example, the depressant, the collector, and then the dispersant can be combined with the liquid mixture in series to form the treated mixture. In another example, the depressant or the collector can be combined with the liquid mixture to form the first mixture, the dispersant can be combined with the first mixture to form the second mixture, and either the depressant or the collector can be combined with the second mixture to form the treated mixture. In yet another example, the dispersant, depressant, and, if present, the collector can be simultaneously combined with the liquid mixture to form the treated mixture.

The treated mixture can have a solids content from a low of about 0.1 wt %, about 1 wt %, about 2 wt %, or about 3 wt % to a high of about 20 wt %, about 40 wt %, about 60 wt %, about 70 wt %, about 80 wt %, or about 90 wt %, based on the total weight of the treated mixture. For example, the treated mixture can have a solids content of about 1 wt % to about 90 wt %, about 3 wt % to about 80 wt %, about 4 wt % to about 70 wt %, about 6 wt % to about 60 wt %, about 10 wt % to about 50 wt %, about 20 wt % to about 70 wt %, about 15 wt % to about 40 wt %, about 7 wt % to about 20 wt %, or about 25 wt % to about 75 wt %.

Depending, at least in part, on the particular ore and/or other value material and/or the particular impurities in the mixture, the amount of the dispersant combined with the mixture can be from a low of about 0.1 kg per tonne of solids in the mixture (kg/tonne), about 0.5 kg/tonne, about 1 kg/tonne, about 2 kg/tonne, about 4 kg/tonne, or about 5 kg/tonne to a high of about 6 kg/tonne, about 8 kg/tonne, about 10 kg/tonne, about 12 kg/tonne, about 14 kg/tonne, or about 15 kg/tonne. For example, the amount of dispersant combined with the mixture can be from about 0.6 kg/tonne to about 6 kg/tonne, about 3.5 kg/tonne to about 10.5 kg/tonne, about 4.5 kg/tonne to about 9.5 kg/tonne, about 2.5 kg/tonne to about 8.5 kg/tonne, about 5 kg/tonne to about 7 kg/tonne, about 4 kg/tonne to about 9 kg/tonne, about 6 kg/tonne to about 9.5 kg/tonne, about 1 kg/tonne to about 7.5 kg/tonne, about 8 kg/tonne to about 14 kg/tonne, or about 1.5 kg/tonne to about 6.5 kg/tonne. In another example, the amount of the dispersant combined with the mixture can be from a low of about 0.1 kg/tonne, about 0.5 kg/tonne, about 1 kg/tonne, about 1.5 kg/tonne, about 2 kg/tonne, or about 2.5 kg/tonne to a high of about 3.5 kg/tonne, about 4 kg/tonne, about 4.5 kg/tonne, about 5 kg/tonne, about 5.5 kg/tonne, or about 6 kg/tonne of solids in the mixture. For example, the amount of dispersant combined with the mixture can be from about 0.7 kg/tonne to about 5.3 kg/tonne, about 1.7 kg/tonne to about 4.3 kg/tonne, about 2.3 kg/tonne to about 3.7 kg/tonne, about 2.7 kg/tonne to about 3.3 kg/tonne, about 2.9 kg/tonne to about 3.1 kg/tonne, about 2 kg/tonne to about 5.8 kg/tonne, about 3.6 kg/tonne to about 4.8 kg/tonne, about 0.8 kg/tonne to about 2.4 kg/tonne, about 1.9 kg/tonne to about 3.4 kg/tonne, or about 2.6 kg/tonne to about 5.4 kg/tonne. The amount of dispersant combined with the mixture can be less than 6.5 kg/tonne, less than 6 kg/tonne, less than 5.5 kg/tonne, less than 5 kg/tonne, less than 4.5 kg/tonne, less than 4 kg/tonne, less than 3.5 kg/tonne, or less than 3 kg/tonne.

Depending, at least in part, on the particular ore and/or other value material and/or the particular impurities in the mixture, the amount of the depressant combined with the mixture can be from a low of about 0.05 kg/tonne, about 0.1 kg/tonne, about 0.5 kg/tonne, about 1 kg/tonne, or about 1.5 kg/tonne to a high of about 2.5 kg/tonne, about 3 kg/tonne, about 3.5 kg/tonne, about 4 kg/tonne, or about 5 kg/tonne. For example, the amount of the depressant combined with the mixture can be from about 0.07 kg/tonne to about 4.6 kg/tonne, about 1 kg/tonne to about 3 kg/tonne, about 0.2 kg/tonne to about 3 kg/tonne, about 1.5 kg/tonne to about 3.3 kg/tonne, about 2.2 kg/tonne to about 3.9 kg/tonne, about 0.5 kg/tonne to about 1.5 kg/tonne, about 0.1 kg/tonne to about 0.45 kg/tonne, or about 0.25 kg/tonne to about 01 kg/tonne. In another example, the amount of the depressant combined with the mixture can be from a low of about 0.05 kg/tonne, about 0.1 kg/tonne, about 0.12 kg/tonne, about 0.15 kg/tonne, or about 0.17 kg/tonne to a high of about 0.23 kg/tonne, about 0.25 kg/tonne, about 0.27 kg/tonne, about 0.3 kg/tonne, about 0.35 kg/tonne, about 0.4 kg/tonne, about 0.45 kg/tonne, or about 0.5 kg/tonne. For example, the amount of the depressant combined with the mixture can be from about 0.07 kg/tonne to about 0.47 kg/tonne, about 0.1 kg/tonne to about 0.4 kg/tonne, about 0.15 kg/tonne to about 0.35 kg/tonne, about 0.17 kg/tonne to about 3.3 kg/tonne, about 0.22 kg/tonne to about 0.29 kg/tonne, about 0.24 kg/tonne to about 0.44 kg/tonne, about 0.1 kg/tonne to about 0.15 kg/tonne, or about 0.25 kg/tonne to about 0.5 kg/tonne. In one or more embodiments, the amount of depressant combined with the mixture can be less than 4 kg/tonne, less than 3.5 kg/tonne, less than 3 kg/tonne, less than 2.5 kg/tonne, less than 2 kg/tonne, less than 1.5 kg/tonne, less than 1 kg/tonne, less than 0.5 kg/tonne, less than 0.45 kg/tonne, less than 0.4 kg/tonne, less than 0.35 kg/tonne, less than 0.3 kg/tonne, or less than 0.25 kg/tonne.

Depending, at least in part, on the particular ore and/or other value material and/or the particular impurities in the mixture, the amount of the collector combined with the mixture can be from a low of about 0.1 kg/tonne, about 0.5 kg/tonne, about 1 kg/tonne, about 1.5 kg/tonne, about 2 kg/tonne, or about 2.5 kg/tonne to about 6 kg/tonne, about 8 kg/tonne, about 10 kg/tonne, or about 12 kg/tonne. For example, the amount of the collector combined with the mixture can be from about 0.7 kg/tonne to about 7 kg/tonne, about 1.7 kg/tonne to about 4.3 kg/tonne, about 2.5 kg/tonne to about 3.5 kg/tonne, about 3 kg/tonne to about 5.7 kg/tonne, about 4.4 kg/tonne to about 8.4 kg/tonne, about 5.5 kg/tonne to about 11.3 kg/tonne, about 6.6 kg/tonne to about 10.2 kg/tonne or about 8.2 kg/tonne to about 11.8 kg/tonne. The amount of collector combined with the mixture can be less than 8 kg/tonne, less than 7 kg/tonne, less than 6 kg/tonne, less than 5 kg/tonne, less than 4 kg/tonne, or less than 3 kg/tonne.

The weight ratio of the dispersant to the depressant in the mixture can range from a low of about 0.1:1, about 1:1, about 2:1, about 4:1, or about 6:1 to a high of about 10:1, about 12:1, about 15:1, about 20:1, about 25:1, about 30:1, about 35:1, or about 40:1. For example, the weight ratio of the dispersant to the depressant in the mixture can be from about 0.5:1 to about 23:1, about 1.5:1 to about 21:1, about 6:1 to about 18:1, about 9.5:1 to about 14.5:1, about 7.5:1 to about 13.5:1, about 11.5:1 to about 12.5:1, about 12:1 to about 22:1, about 15:1 to about 20:1, or about 7:1 to about 17:1. In another example, the weight ratio of the dispersant to the depressant in the mixture can be from about 0.01:1 to about 100:1, about 0.1:1 to about 50:1, about 1:1 to about 20:1, or about 3:1 to about 15:1.

If present, the weight ratio of the collector to the dispersant in the mixture can range from a low of about 0.01:1, about 0.1:1, about 0.5:1, about 1:1, or about 1.5:1 to a high of about 3:1, about 4:1, about 8:1, or about 10:1. For example, the weight ratio of the collector to the dispersant can be from about 0.5:1 to about 2:1, about 1:1 to about 4:1, about 0.3:1 to about 1.3:1, about 3.5:1 to about 9:1, about 6:1 to about 9.5:1, about 4:1 to about 6.3:1, about 0.8:1 to about 1.2:1, about 0.5:1 to about 2:1, or about 1:1 to about 1.5:1.

The weight ratio of the collector to the depressant in the mixture can range from a low of about 0.1:1, about 1:1, about 2:1, about 4:1, or about 6:1 to a high of about 10:1, about 12:1, about 15:1, about 20:1, or about 25:1. For example, the weight ratio of the dispersant to the depressant in the mixture can be from about 0.5:1 to about 23:1, about 1.5:1 to about 21:1, about 6:1 to about 18:1, about 9.5:1 to about 14.5:1, about 7.5:1 to about 13.5:1, about 11.5:1 to about 12.5:1, about 12:1 to about 22:1, about 15:1 to about 20:1, or about 7:1 to about 17:1.

The liquid mixture combined with the dispersant, the depressant, and, if present, the collector can be conditioned for a predetermined period of time. For example, if the dispersant and the depressant are combined with the liquid mixture to form the treated mixture, the dispersant can be added to form a first mixture that can be conditioned and the depressant can be combined with the first mixture, after conditioning, to form the treated mixture. Conditioning the mixture upon the addition of the dispersant can facilitate contact between the liquid mixture and the dispersant and/or depressant and/or collector.

Conditioning can include, but is not limited to, agitating the mixture(s) for a given time period prior to subjecting the mixture to separation. For example, the liquid mixture containing the dispersant, the depressant, the collector, any two thereof, and/or all three can be stirred, blended, mixed, or otherwise agitated for a time from a low of about 30 seconds, about 1 minute, about 2 minutes, about 3 minutes or about 4 minutes to a high of about 5 minutes, about 10 minutes, about 15 minutes, about 20 minutes, about 30 minutes, about 1 hour, or about 24 hours. Conditioning the mixture can also include heating (or cooling) the mixture to a temperature from a low of about 1° C., about 20° C., or about 35° C. to a high of about 60° C., about 80° C., or about 95° C.

Conditioning the mixture can also include adjusting the pH of the mixture. The pH of the liquid mixture containing the dispersant, depressant, and optionally the collector can be from a low of about 2, about 3, about 4, or about 5 to a high of about 8, about 9, about 10, about 11, or about 12. For example, the pH of the mixture can be from about 2 to about 12, about 4 to about 11, or about 6 to about 10. Any one or combination of acid and/or base compounds can be combined with the liquid mixture to adjust the pH thereof.

Illustrative acid compounds that can be used to adjust the pH of the mixture can include, but are not limited to, one or more mineral acids, one or more organic acids, one or more acid salts, or any combination thereof. Illustrative mineral acids can include, but are not limited to, hydrochloric acid, nitric acid, phosphoric acid, sulfuric acid, or any combination thereof. Illustrative organic acids can include, but are not limited to, acetic acid, formic acid, citric acid, oxalic acid, uric acid, lactic acid, or any combination thereof. Illustrative acid salts can include, but are not limited to, ammonium sulfate, sodium bisulfate, sodium metabisulfite, or any combination thereof.

Illustrative base compounds that can be used to adjust the pH of the mixture can include, but are not limited to, hydroxides, carbonates, ammonia, amines, or any combination thereof. Illustrative hydroxides can include, but are not limited to, sodium hydroxide, potassium hydroxide, ammonium hydroxide (e.g., aqueous ammonia), lithium hydroxide, and cesium hydroxide. Illustrative carbonates can include, but are not limited to, sodium carbonate, sodium bicarbonate, potassium carbonate, and ammonium carbonate. Illustrative amines can include, but are not limited to, trimethylamine, triethylamine, triethanolamine, diisopropylethylamine (Hunig's base), pyridine, 4-dimethylaminopyridine (DMAP), and 1,4-diazabicyclo[2.2.2]octane (DABCO).

The one or more ores and/or other value material can include, but is not limited to, phosphorus, lime, sulfates, gypsum, iron, platinum, gold, palladium, cobalt, barium, antimony, bismuth, titanium, molybdenum, copper, uranium, chromium, tungsten, manganese, magnesium, lead, zinc, rare earth elements, clay, coal, silver, graphite, nickel, bauxite, borax, borate, carbonates, a heavy hydrocarbon such as bitumen, or any mixture thereof. In at least one embodiment, the ore can be or include one or more phosphorus containing ores. Illustrative phosphorus containing ores can include, but are not limited to, triphylite, monazite, hinsdalite, pyromorphite, vanadinite, erythrite, amblygonite, lazulite, wavellite, turquoise, autunite, carnotite, phosphophyllite, struvite, one or more apatites, one or more mitridatites, or any mixture thereof. Illustrative apatites can include, but are not limited to, hydroxylapatite, fluorapatite, chlorapatite, bromapatite, or any mixture thereof. Illustrative mitridatites can include, but are not limited to, arseniosiderite-mitridatite and arseniosiderite-robertsite. The rare earth elements can be or include scandium, yttrium, lanthanum, cerium, praseodymium, neodymium, promethium, samarium, europium, gadolinium, terbium, dysprosium, holmium, erbium, thulium, ytterbium, and/or lutetium. Illustrative carbonates can include, but are not limited to, calcium carbonate, sodium carbonate, magnesium carbonate, strontium carbonate, barium carbonate, potassium carbonate, manganese carbonate, iron carbonate, cobalt carbonate, copper carbonate, zinc carbonate, silver carbonate, cadmium carbonate, aluminum carbonate, lead carbonate, lanthanum carbonate, lithium carbonate, rubidium carbonate, cesium carbonate, or any mixture thereof.

Depending on the particular ore and/or other value material, the one or more impurities or contaminants can include, but are not limited to, silica; one or more siliceous materials, e.g., sand; one or more silicates, e.g., aluminum silicate; halite (NaCl); clay; one or more carbonate materials insoluble in water, e.g., calcite and dolomite, anhydrite; metal oxides, e.g., iron oxides, titanium oxides, iron-bearing titania, mica, ilmenite, tourmaline, ferromagnesian, and/or feldspar; debris or various other solid impurities such as igneous rock and soil, metal sulfides, metal oxides, metal sulfates, metal arsenates, or any mixture thereof.

Depending, at least in part, on the particular ore and/or other value material and the one or more contaminants, the separation efficiency of separating the liquid mixture containing the ore can be from a low of about 5%, about 10%, about 15%, or about 20% to a high of about 30%, about 35%, about 40%, about 45%, or about 50%. For example, the separation efficiency of the mixture containing the ore can be about 7% to about 25%, about 15% to about 35%, about 9% to about 43%, about 20% to about 37%, about 10% to about 30%, about 22% to about 38%, or about 24% to about 40%. As used herein, the term "separation efficiency" refers to the percent ore (or other value material) recovered minus (100−the percent of acid insolubles rejected). As used herein, the term "acid insolubles rejection" refers to the amount of contaminants removed from the mixture.

Depending, at least in part, on the particular ore and/or other value material and the one or more contaminants, the concentrate grade of the purified product containing the ore and/or other value material can be from a low of about 5%, about 10%, about 15%, or about 20% to a high of about 50%, about 60%, about 70%, about 80%, or about 90%. For example, the concentrate grade can be about 25% to about 75%, about 10% to about 85%, about 55% to about 85%, about 15% to about 30%, about 20% to about 30%, about 40% to about 90%, or about 5% to about 95%. As used herein, the term "concentrate grade" refers to percent valued ore in the final concentrate.

Depending, at least in part, on the particular ore and/or other value material and the one or more contaminants, the separation process can have an acid insolubles rejection from a low of about 5%, about 10%, about 15% about 20%, or about 25% to a high of about 50%, about 60%, about 70%, about 80%, about 90%, or about 95%. For example, the acid insolubles rejection can be from about 10% about 95%, about 55% to about 85%, about 65% to about 90%, about 35% to about 75%, about 45% to about 85%, or about 55% to about 95%. As used herein, the term "acid insolubles rejection" refers to percent contaminants removed from the valued ore.

Depending, at least in part, on the particular ore and/or other value material and the one or more contaminants, the recovery of the ore and/or other value material in the separation process can be from a low of about 0.01%, about 0.5%, about 1%, about 5%, or about 10% to a high of about 50%, about 70%, about 90%, about 95%, about 99%, about 99.5%, about 99.9%, or about 99.99%. For example, the recovery of the ore and/or other value material in the separation process can be from about 0.01% to about 99.99%, about 1% to about 95%, about 2% to about 80%, about 3% to about 60%, about 35% to about 75%, about 50% to about 90%, about 60% to about 85%, about 40% to about 80%, or about 15% to about 45%.

Depending, at least in part, on the particular ore and/or other value material and the one or more contaminants, the separation process can have a yield percent from a low of about 0.01%, about 0.5%, about 1%, about 5%, or about 10% to a high of about 50%, about 70%, about 90%, about 95%, about 99%, about 99.5%, about 99.9%, or about 99.99%. For example, the yield percent can be about 0.01% to about 99.99%, about 1% to about 95%, about 2% to about 80%, about 3% to about 60%, about 35% to about 75%, about 50% to about 90%, about 60% to about 85%, about 40% to about 80%, about 50% to about 70%, about 45% to about 60%, or about 15% to about 45%. As used herein, the term "yield percent" refers to percent of the original solids of the raw ore that are recovered in the concentrate.

One example of a separation process can include the purification of phosphate ores. For example, clay, sand, and/or other contaminants can be suspended in water to form an aqueous slurry or suspension. A phosphate ore product can be recovered from the slurry having a reduced concentration of at least one contaminant relative to the phosphate slurry before separation.

One example of a liquid suspension that can be purified can include oil and gas drilling fluids, which accumulate solid particles of rock (or drill cuttings) in the normal course of their use. Another example of a liquid suspension can include the clay-containing aqueous suspensions or brines, which accompany ore refinement processes, such as the production of purified phosphate from mined calcium phosphate rock, for example. In the area of slurry dewatering, another specific process can be the filtration of coal from water-containing slurries. Another separation process can include the treatment or purification of sewage to remove various contaminants from industrial and municipal waste water. Such processes can purify sewage to provide both purified water that is suitable for disposal into the environment (e.g., rivers, streams, and oceans) as well as a "sludge." Sewage refers to any type of water-containing wastes which are normally collected in sewer systems and conveyed to treatment facilities. Sewage therefore includes municipal wastes from toilets (sometimes referred to as "foul waste") and basins, baths, showers, and kitchens (sometimes referred to as "sullage water"). Sewage can also include industrial and commercial waste water, (sometimes referred to as "trade waste"), as well as stormwater runoff from hard-standing areas such as roofs and streets. Another separation process can include the purification of pulp and paper mill effluents. These aqueous waste streams normally contain solid contaminants in the form of cellulosic materials (e.g., waste paper; bark or other wood elements, such as wood flakes, wood strands, wood fibers, or wood particles; or plant fibers such as wheat straw fibers, rice fibers, switchgrass fibers, soybean stalk fibers, bagasse fibers, or cornstalk fibers; and mixtures of these contaminants). The effluent stream containing one or more cellulosic solid contaminants can be treated and purified water can be removed via sedimentation, flotation, and/or filtration.

Another separation process can include the removal of suspended solid particulates, such as sand and clay, in the purification of water, and particularly for the purpose of rendering it potable. Moreover, the dispersant, depressant, and/or collector can have the additional ability to complex metallic cations (e.g., lead and mercury cations) allowing these unwanted contaminants to be removed in conjunction with solid particulates. As such, impure water having both solid particulate contaminants as well as metallic cation contaminants can be purified.

The separation or purification of the mixture containing the ore and/or other value material and the one or more contaminants can include froth flotation. Froth flotation is a separation process based on differences in the tendency of various materials to associate with rising air bubbles. The dispersant, depressant, and optionally collector, as well as other additives can be combined with the ore and/or other value material containing the one or more contaminants and mixed with the liquid to improve the selectivity of the separation process. A gas, e.g., air, can be flowed, forced, or otherwise passed through the mixture. Some materials (e.g., value minerals) will, relative to others (e.g., contaminants), exhibit preferential affinity for air bubbles, causing them to rise to the surface of the aqueous slurry, where they can be collected in a froth concentrate. A degree of separation is thereby provided. In "reverse" froth flotation, it is the contaminant that can preferentially float and concentrated at the surface, with the ore and/or other value material concentrated in the bottoms. Froth flotation is a separation process well known to those skilled in the art.

Other separation processes, in addition to froth flotation, for the purification of the ore or other value material from the one or more contaminants can include sedimentation, i.e., the value material or the contaminants are allowed to settle as a bottoms and a liquid containing the value material having a reduced concentration of the contaminants can be revered. In another example, the value material can settle as the bottoms product with the one or more contaminants remaining dispersed in the liquid. Coagulation, which refers to the destabilization of suspended solid particles by neutralizing the electric charge that separates them can also be used. Flocculation, which refers to the bridging or agglomeration of solid particles together into clumps or flocs, thereby facilitating their separation by settling or flotation, depending on the density of the flocs relative to the liquid can also be used. Filtration can also be employed as a means to separate the larger flocs. These types of separation processes are well known to those of skill in the art.

In the separation of solids from aqueous liquids, other specific applications of industrial importance include the filtration of coal from water-containing slurries (i.e., slurry dewatering), the treatment of sewage to remove contaminants (e.g., sludge) via sedimentation, and the processing of pulp and paper mill effluents to remove suspended cellulosic solids. The dewatering of coal poses a significant problem industrially, as the BTU value of coal decreases with increasing water content. The removal of sand from aqueous bitumen-containing slurries generated in the extraction and subsequent processing of oil sands, can also be carried out. Also, the removal of suspended solid particulates from water can be carried out to produce a purified water, such as in the preparation of drinking (i.e., potable) water.

Various dispersants for use in separation processes are known to those of ordinary skill in the art and can include, but are not limited to, silica, silicates, polysiloxanes, starches, modified starches, gums, tannins, lignosulphonates, carboxyl methyl cellulose, cyanide salts, polyacrylic acid based polymers, naphthalene sulfonates, benzene sulfonates, pyrophosphates, phosphates, phosphonates, tannate, polycarboxylate polymers, polysaccharides, dextrin, sulfates, or any mixture thereof. In at least one example, the dispersant can be or include one or more silicates.

Illustrative silicates can include, but are not limited to, sodium silicate or "water glass," potassium silicate, or any mixture thereof. Illustrative polysiloxanes can include, but are not limited to, hexamethylcyclotrisiloxane, hexamethyldisiloxane, octamethylcyclotetrasiloxane, octamethyltrisiloxane, decamethylcyclopentasiloxane, decamethyltetrasiloxane, dodecamethylcyclohexasiloxane, polydimethylsiloxane or any mixture thereof. Illustrative starches can include, but are not limited to, maize or corn starch, waxy maize starch, high amylose maize starch, potato starch, tapioca starch, wheat starch, corn meal, or any mixture thereof. Illustrative modified starches can include, but are not limited to, dextrin, caustized starch, cationic starch, carboxymethylstarch, or any mixture thereof. The tannins can include hydrolyzable tannins and/or condensed tannins. Illustrative hydrolyzable tannins can include, but are not limited to, extracts recovered from *Castanea sativa*, (e.g., chestnut), *Terminalia* and *Phyllanthus* (e.g., myrabalans tree species), *Caesalpinia coriaria* (e.g., divi-divi), *Caesalpinia spinosa*, (e.g., tara), algarobilla, valonea, *Quercus* (e.g., oak), or any mixture thereof. Illustrative condensed tannins can include, but are not limited to, *Acacia mearnsii* (e.g., wattle or mimosa bark extract), *Schinopsis* (e.g., quebracho wood extract), *Tsuga* (e.g., hemlock bark extract), *Rhus* (e.g., sumach extract), *Juglans* (e.g., walnut), *Carya illinoinensis* (e.g., pecan), and *Pinus* (e.g., Radiata pine, Maritime pine, bark extract species). Illustrative lignosulphonates can include, but are not limited to, calcium lignosulfonate, magnesium lignosulfonate, or any mixture thereof. Illustrative cyanide salts can include, but are not limited to, sodium cyanide, potassium cyanide, calcium cyanide, magnesium cyanide or any combination thereof. Illustrative polyacrylic acid based polymers can include, but are not limited to sodium polyacrylate, potassium polyacrylate, polymethacrylic acid, copolymers of any combination of acylic acid, methacrylic acid, acrylate, methacrylate, maleic acid, fumaric acid, maleic anhydride, or any combination thereof. A suitable sodium salt of a polyacrylic acid based polymer can include ACUMER® 9141, available from Rohm and Haas. Illustrative naphthalene sulfonates can include, but are not limited to, sodium naphthalene sulfonate, potassium naphthalene sulfonate, or a mixture thereof. Illustrative benzene sulfonates can include, but are not limited to, alkylbenzene sulfonates, benzene disulfonates, sodium benzene sulfonate, potassium benzene sulfonate, or any mixture thereof. Illustrative pyrophosphates can include, but are not limited to, alkylpyrophosphates, sodium pyrophosphate, potassium pyrophosphate, calcium pyrophosphate, magnesium pyrophosphate or any mixture thereof. Illustrative phosphates can include, but are not limited to, phosphate esters, sodium phosphate, potassium phosphate, calcium phosphate, magnesium phosphate, or any mixture thereof. Illustrative phosphonates can include, but are not limited to alkyl phosphonates, aryl phosphonates, aryl polyphosphonates, alkyl polyphosphonates or any mixture thereof. Illustrative polycarboxylate polymers can include, but are not limited to, sodium polyacrylate, potassium polyacrylate, polymethacrylic acid, copolymers of any combination of acylic acid, methacrylic acid, acrylate, methacrylate, maleic acid, fumaric acid, maleic anhydride, or any combination thereof, carboxymethyl cellulose or any mixture thereof.

Various collectors for use in separation processes are known to those of ordinary skill in the art. The collector can be or include, but is not limited to, one or more fatty acids, one or more oxidized fatty acids, one or more maleated fatty acids, one or more oxidized and maleated fatty acids, one or more fatty acid monoesters of a polyol, one or more fatty acid diesters of a polyol, one or more amines, xanthates, one or more fuel oils, fatty acid soaps, nonionic surfactants, crude tall oil, oleic acid, tall oil fatty acids, saponified natural oils, alkyl dithiophosphates, alkyl thiophosphates fatty hydroxamates, alkyl sulfonates, alkyl sulfates, alkyl phosphonates, alkyl phosphates, alkyl ether amines, alkylether diamines, alkyl amido amines, or any mixture thereof.

Illustrative fatty acids can include aliphatic C8 to C22 carboxylic acids. Representative fatty acids can include, but are not limited to, oleic acid, lauric acid, linoleic acid, linolenic acid, palmitic acid, stearic acid, riccinoleic acid, myristic acid, arachidic acid, behenic acid and mixtures thereof. Through the use of known saponification techniques, a number of vegetable oils, such as linseed (flaxseed) oil, castor oil, tung oil, soybean oil, cottonseed oil, olive oil, canola oil, corn oil, sunflower seed oil, peanut oil, coconut oil, safflower oil, palm oil, and any mixture thereof can be used as a fatty acid source. Another source for fatty acids an include tall oil. Suitable tall oils can include crude tall oil, distilled tall oil, tall oil fatty acids, or any mixture thereof. One particular source of fatty acids can be distilled tall oil, which can contain no more than about 10% rosin acid and other constituents and can be referred to as TOFA (Tall Oil Fatty Acid). Illustrative amines can include, but are not limited to, dodecylamine, octadecylamine, alpha-aminoarylphosphonic acid, sodium sarcosinate, alkyl ether amines, alkylether diamines, alkyl amido amines, or ay mixture thereof. Illustrative fuel oils can include, but are not limited to, diesel oil, kerosene, furnace oil, Bunker C fuel oil, mineral oil, and any mixture thereof.

Oxidized fatty acids can include two or more fatty acid backbone structures, where each backbone structure is linked to one other backbone structure by a bridging group chosen from a direct bond, an ether linkage, or a peroxide linkage located at a non-terminal position of each fatty acid backbone structure. The fatty acid backbone structure can be chosen from, for example, $C_{10}$-$C_{22}$ fatty acids, $C_{16}$-$C_{22}$ fatty acids, or $C_{16}$-$C_{18}$ fatty acids. For example, the fatty acid backbone structure can be oleic acid, linoleic acid, linolenic acid, or any mixture thereof. Maleated fatty acids can include fatty acids modified by reaction with one or more of an $\alpha,\beta$ unsaturated carboxylic acid or anhydride, e.g., maleic anhydride. For example, the maleated fatty acids can include at least one backbone structure substituted by at least one $\alpha,\beta$ unsaturated carboxylic acid or anhydride. Oxidized and maleated fatty acids can include two or more hydrocarbon-based backbone structures, where at least one backbone structure is substituted by at least one $\alpha,\beta$ unsaturated carboxylic acid or anhydride, and where each backbone structure is linked to one other backbone structure by a bridging group chosen from a direct bond, an ether linkage, or a peroxide linkage located at a non-terminal position of each backbone structure.

Suitable polyols for reacting with fatty acids (or with fatty acid derivatives) to produce the fatty acid monoesters and/or fatty acid diesters with polyols can include, but are not limited to, diethylene glycol, glycerol (glycerine), ethylene glycol, propylene glycol, polyethylene glycols, polypropylene glycols, cyclohexanediol, cyclopentanediol, polyethylene and polypropylene glycol copolymers, 1,3-propanediol, butyne-1,4-diol, 1,4-butanediol, 1,6-hexanediol, pentaerthritol, trimethylol propane, triethanolamine, diethanolamine, diisopropanolamine, dihydroxyacetone, biogenic polyhydric alcohols such as panthenol, or any mixture thereof. Another class of polyols or polyhydric alcohols can include carbohydrates, in particular monosaccharides, oligosaccharides, polyglycerols and alkyl glycosides having 1 to 20 carbon atoms in the alkyl radical. Suitable monosaccharides can include, but are not limited to erythrose, threose, arabinose, ribose, xylose, glucose, mannose, galactose, fructose, sorbose, sorbitol, manitol and dulcitol. Oligosaccharides can include disaccharides such as sucrose, trehalose, lactose, maltose and cellobiose, trisaccharides, and raffinose. Sugar alcohols, such as selected from sorbitol, xylitol or erythritol, and/or alkyl glycosides such as methyl glycoside can also be used.

Suitable fatty acids, maleated fatty acids, oxidized fatty acids, and/or maleated and oxidized fatty acids that can be used as the collector can include those discussed and described in U.S. Pat. Nos. 8,071,715 and 8,133,970; and U.S. Patent Application Publication Nos.: 2008/0179570; 2009/0065736; 2008/0178959; 2009/0194731; and 2010/0000913. Suitable fatty acid monoesters of a polyol and one or more fatty acid diesters of a polyol can be as discussed and described in U.S. Patent Application Publication No.: 2009/0178959.

The depressant can include one or more amine-aldehyde resins; one or more modified amine-aldehyde resins; one or more Maillard reaction products; a mixture of one or more polysaccharides and one or more resins having azetidinium functional groups; one or more polysaccharides cross-linked with one or more resins having azetidinium functional groups; or any mixture thereof.

In at least one embodiment, the amine-aldehyde resin can be or include one or more cationic polymers formed by reacting an aldehyde with guanidine and optionally an aldehyde reactive compound, where the guanidine is provided in an amount sufficient to provide the polymer with a net cationic charge, also referred to as the "guanidine-aldehyde polymer" or simply "guanidine polymer." As used herein, the term "polymer," when referring to the guanidine polymer, refers to molecules composed of repeating structural units of an aldehyde, of an optional aldehyde-reactive monomer, and of guanidine. The repeating structural units can be connected by covalent chemical bonds. The term "polymer" is not intended to imply any particular range of molecular weights and would encompass molecules commonly referred to as oligomers as well.

The cationic polymer can be a molecule that under an appropriate pH condition in an aqueous environment possesses a net cationic (positive) charge. In its solid state, the cationic polymer can be associated with a counter-ion and the counter-ion or anion can become disassociated from the polymer when the cationic polymer is introduced into an aqueous environment. When determining the weight percent of various monomers as a function of the cationic polymer, the cationic polymer is considered to be independent of the counter-ion. The presence of the cationic charge can be verified by ion-exchange chromatography and/or ionic polymer titrations used in such instruments as the Mutek PCD.

The cationic polymers can be formed by reacting an aldehyde with guanidine. In another example, the cationic polymers can be formed by reacting an aldehyde with guanidine and an optional aldehyde-reactive compound. The guanidine can be provided in an amount sufficient to provide the polymer with a net cationic charge.

The aldehyde can be or include formaldehyde. Any form of formaldehyde can be used. For example, paraformaldehyde or paraform (a solid, polymerized formaldehyde) and/or formalin solutions (aqueous solutions of formaldehyde, sometimes with methanol, in 37 wt %, 44 wt %, or 50 wt % formaldehyde concentrations). Formaldehyde gas can also be used. In at least one example, a low methanol-containing 50 wt % formaldehyde aqueous solution can be used. In another example, the formaldehyde substituted in part or in whole with substituted aldehydes such as acetaldehyde and/or propylaldehyde can be used as the source of formaldehyde. Other suitable aldehydes can also include aromatic aldehydes (e.g., benzylaldehyde and furfural), and other aldehydes such as aldol, glyoxal, and crotonaldehyde. Mixtures of aldehydes can also be used. Thus, as used herein, the term "formaldehyde" is not limited to formaldehyde, but also denotes the use of formaldehyde alternatives.

Guanidine ($H_2N—C(NH)—NH_2$) is a primary amine having at least two functional amine (amino) groups. Guanidine is reactive with formaldehyde and related aldehydes. Guanidine can introduce the cationic character to the polymer. Guanidine is an alkaline material and has a $pK_a$ of about 12.5 and thus usually exits in an aqueous media as a charged cation except under alkaline or highly alkaline conditions. Guanidine can be used in the form of one of its salts such as guanidine carbonate, guanidine hydrogen chloride (guanidinium chloride), guanidine sulfate, guanidine nitrate, or any combination thereof. In one example, the guanidine carbonate salt can be used and the counter anion (carbonate) can be removed as carbon dioxide during the synthesis of the cationic polymer. As used herein, the term "guanidine" refers to not only the free base, but also any of its salt forms.

The guanidine can be provided for reaction with the aldehyde and the optional aldehyde-reactive compound in an amount sufficient to provide the polymer with a net cationic charge. The amount of guanidine provided can be sufficient so that on average each polymer molecule has at least one guanidine monomer unit. For example, the amount of guanidine provided can be sufficient so that on average each cationic polymer molecule has at least 1, 2, 3, 4, 5, 6, 7, 8, 9, 10, or more guanidine monomer units. The molar ratio of guanidine to the total amount of any optional aldehyde-reactive compound(s) that can be included in the cationic polymer can be at least 1:99 or at least 10:90. There is no upper limit for the mole ratio of the guanidine to the total amount of any optional aldehyde-reactive compound(s) that include the cationic polymer, as forming the cationic polymer by reacting only guanidine and an aldehyde, such as formaldehyde is contemplated.

Formaldehyde is known to be reactive with a variety of compounds for making oligomeric and polymeric materials; often identified as resinous materials. As used herein, the term "aldehyde-reactive compound" and similar phrases is intended to include compounds that one or more aldehyde reactive functional groups and are capable of reacting with formaldehyde and other similar aldehydes for making a polymer. The "aldehyde-reactive compounds" can include ammonia, primary amines, secondary amines, phenols compounds (e.g., phenolic compounds), and mixtures thereof. Even though formaldehyde is also reactive with guanidine (and a cationic copolymer formed by reaction between an aldehyde and guanidine alone is embraced in the present disclosure), for purpose of the present disclosure "guanidine" is expressly excluded from the definition of "aldehyde-reactive compound."

Ammonia is available in various gaseous and liquid forms, particularly including aqueous solutions at various concentrations. Any of these forms is suitable for use. Commercially-available aqueous ammonia-containing solutions typically containing between about 10 wt % and about 35 wt % ammonia are available. For example, an aqueous solution containing about 28 percent ammonia can be used.

The primary and secondary amines can include compounds having at least two functional amine (amino) groups, or at least two functional amide groups, or amidine compounds having at least one of each of these groups. Such compounds can include ureas, other guanidine like compounds, and melamines, which can be substituted at their respective amine nitrogen atoms with aliphatic or aromatic radicals, wherein at least two nitrogen atoms are not completely substituted and thus are available for reaction with the aldehyde. In at least one example, one or more primary amines can be used. Other suitable amines can include primary alkylamines, alkanolamines, polyamines (e.g., alkyl primary diamines such as ethylene diamine and alkyl primary triamines such as diethylene triamine), polyalkanolamines, melamine or other amine-substituted triazines, dicyandiamide, substituted or cyclic ureas (e.g., ethylene urea), guanidine derivatives (e.g., cyanoguanidine and acetoguanidine), or any combination thereof.

Urea can be used as the optional aldehyde-reactive compound in producing a suitable cationic polymer. Solid urea, such as prill, and urea solutions, typically aqueous solutions, can be used. Further, urea can be combined with another moiety, most typically formaldehyde and urea-formaldehyde, often in aqueous solution. Any form of urea or urea in combination with formaldehyde can be used. Both urea prill and combined urea-formaldehyde products can be used, such as Urea Formaldehyde Concentrate ("UFC"), particularly UFC 85. These types of products are disclosed in, for example, U.S. Pat. Nos. 5,362,842 and 5,389,716.

Any suitable phenol or combination of phenols can also be used. For example, phenol itself, i.e., hydroxybenzene, can be used. In another example, phenol can be replaced, partially or totally, with other phenols that are un-substituted at the two ortho positions, or at one ortho and the para position. Thus, as used herein, the terms "phenol" and "phenols" can refer to phenol derivatives, as well as phenol itself. Any one, all, or none of the remaining carbon atoms of the phenol ring can be substituted. The nature of the substituents can vary widely, preferably interference in the polymerization of the aldehyde with the phenols at the ortho and/or para positions is absent or minimal. Optional substituted phenols that can be used can include alkyl substituted phenols, aryl substituted phenols, cycloalkyl substituted phenols, alkenyl substituted phenols, alkoxy substituted phenols, aryloxy substituted phenols, and halogen substituted phenols, with the foregoing substituents having from 1 to about 26 carbon atoms or from 1 to about 9 carbon atoms. Phenol can also be replaced with natural phenolic compounds that can react with more than one equivalent of formaldehyde on a molar basis, such as tannins and/or lignin. Other examples of suitable phenols (phenolic compounds) that can be used in preparing the cationic polymer can include, but are not limited to, bis-phenol A, bis-phenol F, resorcinol, o-cresol, m-cresol, p-cresol, 3,5-5 xylenol, 3,4-xylenol, 3,4,5-trimethylphenol, 3-ethyl phenol, 3,5-diethyl phenol, p-butyl phenol, 3,5-dibutyl phenol, p-amyl phenol, p-cyclohexyl phenol, p-octyl phenol, 3,5 dicyclohexyl phenol, p-phenyl phenol, p-phenol, 3,5-dimethoxy phenol, 3,4,5 trimethoxy phenol, p-ethoxy phenol, p-butoxy phenol, 3-methyl-4-methoxy phenol, p-phenoxy phenol, naphthol, anthranol, catechol, phloroglucinol, catechins and substituted derivatives thereof.

Mixtures of the optional aldehyde-reactive compounds can also be used. For example, a mixture or combination of ammonia and urea as the optional aldehyde-reactive compound can be used. In another example, the optional aldehyde-reactive compound can include ammonia, urea, phenolic compounds, or mixtures thereof. For example, the optional aldehyde-reactive compound can include two or more of ammonia, urea, one or more primary amines, one or more secondary amines, and one or more phenol or phenolic compounds.

In one example, the cationic polymer can be a copolymer of an aldehyde (or a mixture of aldehydes) and guanidine. In another example, the cationic polymer can include at least a terpolymer of an aldehyde, e.g., formaldehyde, guanidine, and an aldehyde-reactive compound, e.g., urea. The guanidine monomer units can, on average, be present in the cationic polymer in an amount from a low of about 1 wt %, about 5 wt %, about 8 wt %, or about 12 wt % to a high of about 15 wt %, about 30 wt %, about 45 wt %, or about 60 wt %. For example, the guanidine monomer units can, on average, constitute at least 1 wt % and up to about 58 wt % of the cationic polymer, from at least 3 wt % and up to about 40 wt % of the cationic polymer, or from at least 5 wt % up to about 10 wt % of the cationic polymer. In another example, the amount of guanidine monomer units in the cationic polymer can, on average, range from a low of about 1 wt %, about 4 wt %, about 6 wt %, or about 8 wt % to a high of about 12 wt %, about 15 wt %, about 20 wt %, about 25 wt %, about 30 wt %, about 35 wt %, about 40 wt %, or about 45 wt % of the cationic polymer. In yet another example, the guanidine monomer units can, on average, constitute about 5 wt % to about 50 wt % of the cationic polymer, about 4 wt % to about 15 wt % of the cationic polymer, or about 1 wt % to about 55 wt % of the cationic polymer. In still another example, the guanidine monomer units in the cationic polymer can, on average, constitute at least 1 wt % to about 50 wt %, at least 2 wt % to about 40 wt %, at least 3 wt % to about 30 wt %, at least 2 wt % to about 20 wt %, or at least 4 wt % to about 25 wt % of the cationic polymer. In yet another example, the guanidine monomer units in the cationic polymer can, on average, constitute at least 1 wt %, at least 2 wt %, at least 3 wt %, or at least 4 wt % and less than about 58 wt %, less than about 55 wt %, less than about 50 wt %, less than about 45 wt %, less than about 40 wt %, less than about 35 wt %, less than about 30 wt %, less than about 25 wt %, less than about 20 wt %, or less than about 15 wt % of the cationic polymer.

The molar ratios between the aldehyde and the sum of guanidine and the optional aldehyde-reactive compound(s) can vary considerably depending on the specific reactants and/or their degree of functionality. For example, the molar ratio of the moles aldehyde (F) to the sum of moles guanidine (G) and the moles of any aldehyde-reactive compound (s) (R), i.e., (F:(G+R)), can range from about 1:2 (alternatively designated as 0.5:1) to about 3:1. In another example, the molar ratio of the moles aldehyde (F) to the sum of moles guanidine (G) and the moles of the optional aldehyde-reactive compound(s) (R) can range from a low of about 1:3, about 1:2, about 1:1.5, or about 1:1 to a high of about 1.5:1, about 2:1, about 2.5:1, about 3:1, or about 3.5:1. In another example, in the case of formaldehyde (F), guanidine (G) and urea (U), the molar ratio (F:(G+U)) can range from about 1:2 to about 3.5:1, about 1.5:1 to about 3:1, about 2:1 to about 3:1, about 2.5:1 to about 3:1, or about 1.5:1 to about 2.5:1. In still another example, in the case of formaldehyde (F), guanidine (G) and phenol (P), the molar ratio of (F:(G+P)) can range from about 1:2.5 to about 3.5:1, about 1:2 to about 3:1, about 1:1.5 to about 2.5:1, about 1:1 to about 2:1, or about 1:1.5 to about 2.5:1. The molar ratio of the aldehyde to the sum of the optional aldehyde-reactive compound and the guanidine can be selected so that the cationic polymer that results from the chemical reactions has one or more desired properties, such as molecular weight, cationic content, solubility, and/or anionic polymer flocculant ability. Those skilled in the art of aldehyde chemistry can identify, if necessary, with the exercise of only routine experimentation, a suitable mole ratio to use when reacting an aldehyde, guanidine and an optional aldehyde-reactive compound.

The cationic polymer can be prepared by reacting the aldehyde, guanidine, and the optional aldehyde-reactive compound using a variety of approaches. For example, U.S. Pat. Nos. 1,658,597; 1,780,636; and 2,668,808 describe the condensation reaction that occurs between aldehydes, such as formaldehyde, and guanidine. As recognized by those skilled in the art, methods for synthesizing aldehyde polymers is ubiquitous in the prior art, and such prior art techniques are readily applied to the synthesis of the cationic polymer as discussed herein.

In the case of preparing a cationic polymer using formaldehyde, urea and guanidine, known procedures for reacting amines with formaldehyde can be used. For example, the guanidine to be used, e.g., guanidine carbonate, can simply be substituted for a portion of the urea during the synthesis. At a sufficiently high pH, it is possible for reactions to proceed essentially in the absence of condensation reactions. For example, the reaction mixture can be maintained at a pH typically from about 5 to about 10, or a pH that ranges from a low of about 5, about 5.6, or about 6.2 to a high of about 7.8, about 8.8, or about 10. If desired, an acid, such as sulfuric acid or acetic acid, can be used to control the pH and accordingly the rate of condensation (which ultimately determines the molecular weight of the condensed polymer). Reaction temperatures can range from about 30° C. to about 100° C., and typically can be about 95° C., though use of the reflux temperature can be suitable in some circumstances. A reaction time from about 15 minutes to about 3 hours or from about 30 minutes to about 2 hours can be used.

The reaction can be conducted in an aqueous solution. Water can provide a suitable way (heat sink) for controlling exothermic reactions. A reaction conducted in an aqueous solution or other mixture, can include an amount of water sufficient to limit the reactants to not more than 80 wt % of the reaction mixture. For example, an aqueous reaction mixture can include an amount of water sufficient such that the reactants make up about 10 wt % to about 80 wt % of the reaction mixture, from about 20 wt % to about 70 wt % of the reaction mixture, or from about 20 wt % to about 65 wt % of the reaction mixture. Accordingly, the cationic polymer can be produced as an aqueous mixture containing no more than 80 wt % solids, between about 20 wt % and about 70 wt % solids, between about 20 wt % and about 65 wt % solids, or between about 20 wt % and about 60 wt % solids. In another example, the cationic polymer can be produced as an aqueous mixture having an amount of solids ranging from a low of about 10 wt %, about 20 wt %, about 30 wt %, or about 40 wt % to a high of about 60 wt %, about 65 wt %, about 70 wt %, or about 75 wt % by weight.

The reaction can be conducted to a specific viscosity endpoint in order to facilitate subsequent handling of the cationic polymer. For example, the reaction can be allowed to progress until the aqueous reaction system reaches a viscosity of no higher than H on the Gardner-Holt scale or a viscosity no higher than G on the Gardner-Holt scale.

The aqueous solution of the cationic polymer can then be used directly in its liquid form or it can be further diluted before use, for enhancing or for facilitating a particular solids-liquid separation process. In another example, the cationic polymer could be isolated as a particulate solid, for example by spray drying, or by freeze drying the aqueous reaction mixture before use in a particular solids-liquid separation process. Isolating the cationic polymer in the form of a particulate solid also facilitates its storage, handling, and shipment. Aqueous preparations then could be reconstituted from the particulate solids as desired.

Other suitable amine-aldehyde resins can include, but are not limited to, urea-formaldehyde resin, a melamine-formaldehyde resin, or a melamine-urea formaldehyde resin. For example, another amine-formaldehyde resin suitable for use as the depressant can be or include a urea-formaldehyde resin having a formaldehyde to urea molar ratio of about 1.5:1 to about 4:1, wherein the resin is prepared using an alkaline catalyst. In another example, the amine-aldehyde resin can be or include a urea-formaldehyde resin having a concentration of free formaldehyde of less than 1%, based on the total weight of the urea-formaldehyde resin. In another example, the amine-aldehyde resin can be or include a resin prepared by reacting formaldehyde, urea, triethanolamine, and optionally ammonia to produce a resin. For example, the formaldehyde, urea, triethanolamine and optionally ammonia reactants can be mixed at an alkaline pH and heated for a time sufficient to obtain metholylation of the urea. The reactants being present in an amount of about 1.50 to 4.0 moles of formaldehyde, about 0.001 to 0.1 moles of triethanolamine, and about 0 to 0.5 moles ammonia, per mole of urea. An acid can be added during the reaction to lower the pH to within a range of about 4.9 to about 5.2 and urea can be added to provide a molar ratio of formaldehyde to urea from about 1.5:1 to about 2.5:1. The reaction can be conducted for a time sufficient to reduce free formaldehyde to less than 2%. Suitable amine-aldehyde resins can include those discussed and described in U.S. Patent Application Publication Nos.: 2006/0151397 and 2007/0012630 and U.S. Pat. No. 8,127,930.

Suitable modified amine-aldehyde resins can include amine-aldehyde resins modified with one or more coupling agents. The coupling agents can be selected to provide a modified amine-aldehyde resin having a greater selectivity or preference for a particular contaminant, ore, or other value material. For example, the coupling agent can improve the selectivity of the modified amine-aldehyde resin for a contaminant such as sand or clay as compared to the same resin but not modified with the coupling agent. Illustrative coupling agents can include silane coupling agents.

The coupling agent can be added before, during, or after the adduct-forming reaction, as described above, between the primary or secondary amine and the aldehyde. For example, the coupling agent can be added after an amine-aldehyde adduct is formed under alkaline conditions, but prior to reducing the pH of the adduct (e.g., by addition of an acid) to effect condensation reactions. The coupling agent can be covalently bonded to the base resin by reaction between a base resin-reactive functional group of the coupling agent and a moiety of the base resin.

The coupling agent can also be added after the condensation reactions that yield a low molecular weight polymer. For example, the coupling agent can be added after increasing the pH of the condensate (e.g., by addition of a base) to halt condensation reactions. Advantageously, it has been found that the base resin can be sufficiently modified by introducing the coupling agent to the resin condensate at an alkaline pH (i.e., above pH 7), without appreciably advancing the resin molecular weight. The resin condensate can be in the form of an aqueous solution or dispersion of the resin. When substituted silanes are used as coupling agents, they can effectively modify the base resin under alkaline conditions and at either ambient or elevated temperatures. Any temperature associated with adduct formation or condensate formation during the preparation of the base resin, as described above, can be used to incorporate the coupling agent, thus providing the modified amine-aldehyde resin. As with the resin condensation reactions described above, the extent of the reaction can be monitored by the increase in the viscosity of the reaction mixture over time. Alternatively, in some cases the silane coupling agent can be added to the liquid that is to be purified (e.g., the froth flotation slurry) and that contains the base resin, in order to modify the base resin in situ.

A representative coupling agents that can modify the amine-aldehyde resin can include, but are not limited to, one or more silane s. The silane coupling agent can be a substituted silane. The substituted silane can possess both a base resin-reactive group (e.g., an organofunctional group) and a second reactive group (e.g., a trimethoxysilane group) that is capable of adhering to, or interacting with, unwanted impurities such as siliceous materials. Without being bound by theory, the second group can cause the impurities to agglomerate into larger particles or flocs (i.e., by flocculation), upon treatment with the modified resin, which can facilitate the removal of the impurities. In the case of ore froth flotation separations, for example, the second group of the coupling agent can promote the sequestering of either gangue impurities or desired materials (e.g., kaolin clay) in the aqueous phase, in which the base resin is soluble or for which the base resin has a high affinity. This can improve the separation of value materials from the aqueous phase by flotation with a gas such as air.

Representative amine-aldehyde resin-reactive groups of the silane coupling agents can include, but are not limited to, ureido-containing moieties (e.g., ureidoalkyl groups), amino-containing moieties (e.g., aminoalkyl groups), sulfur-containing moieties (e.g., mercaptoalkyl groups), epoxy-containing moieties (e.g., glycidoxyalkyl groups), methacryl-containing moieties (e.g., methacryloxyalkyl groups), vinyl-containing moieties (e.g., vinylbenzylamino groups), alkyl-containing moieties (e.g., methyl groups), or haloalkyl-containing moieties (e.g., chloroalkyl groups). Representative substituted silane coupling agents of the present invention therefore include ureido substituted silanes, amino substituted silanes, sulfur substituted silanes, epoxy substituted silanes, methacryl substituted silanes, vinyl substituted silanes, alkyl substituted silanes, and haloalkyl substituted silanes.

It is also possible for the silane coupling agent to be substituted with more than one reactive group. For example, the tetravalent silicon atom of the silane coupling agent can be independently substituted with two or three of the base-resin reactive groups described above. As an alternative to, or in addition to, substitution with multiple amine-aldehyde reactive groups, the silane coupling agent can also have multiple silane functionalities. The degree of silylation of the silane coupling agent can be increased, for example, by incorporating additional silane groups into coupling agent or by cross-linking the coupling agent with additional silane-containing moieties. The use of multiple silane functionalities can even result in a different orientation between the coupling agent and clay surface (e.g., affinity between the clay surface and multiple silane groups at the "side" of the coupling agent, versus affinity between a single silane group at the "head" of the coupling agent).

The second group of the silane coupling agent can also include the silane portion of the molecule, that is typically substituted with one or more groups selected from: alkoxy (e.g., trimethoxy), acyloxy (e.g., acetoxy), alkoxyalkoxy (e.g., methoxyethoxy), aryloxy (e.g., phenoxy), aroyloxy (e.g., benzoyloxy), heteroaryloxy (e.g., furfuroxy), haloaryloxy (e.g., chlorophenoxy), heterocycloalkyloxy (e.g., tetrahydrofurfuroxy), and the like. Representative silane coupling agents, having both base resin-reactive groups and second groups (e.g., gangue-reactive groups) as described above, for use in modifying the base resin, therefore include ureidopropyltrimethoxysilane, ureidopropyltriethoxysilane, aminopropyltrimethoxysilane, aminopropyltriethoxysilane, aminopropylmethyldiethoxysilane, aminopropylmethyldimethoxysilane, amino ethylaminopropyltrimethoxysilane, aminoethylaminopropyltriethoxysilane, amino ethylaminopropylmethyldimethoxysilane, diethylenetriaminopropyltrimethoxysilane, diethylenetriaminopropyltriethoxysilane, diethylenetriaminopropylmethyldimethoxysilane, diethylenetriaminopropylmethyldiethoxysilane, cyclohexylaminopropyltrimethoxysilane, hexanediaminomethyltriethoxysilane, anilinomethyltrimethoxysilane, anilinomethyltriethoxysilane, diethylaminomethyltriethoxysilane, (diethylaminomethyl)methyldiethoxysilane, methylaminopropyltrimethoxysilane, bis(triethoxysilylpropyl) tetrasulfide, bis(triethoxysilylpropyl)disulfide, mercaptopropyltrimethoxysilane, mercaptopropyltriethoxysilane, mercaptopropylmethyldimethoxysilane, 3-thiocyanatopropyltriethoxysilane, isocyanatopropyl triethylsilane, glycidoxypropyltrimethoxysilane, glycidoxypropyltriethoxysilane, glycidoxypropylmethyldiethoxysilane, glycidoxypropylmethyldimethoxysilane, methacryloxypropyltrimethoxysilane, methacryloxypropyltriethoxysilane, methacryloxypropylmethyldimethoxysilane, chloropropyltrimethoxysilane, chloropropyltriethoxysilane, chloromethyltriethoxysilane, chloromethyltrimethoxysilane, dichloromethyltriethoxysilane, vinyltrimethoxysilane, vinyltriethoxysilane, vinyltris(2-methoxyethoxy)silane, vinyltriacetoxysilane, alkylmethyltrimethoxysilane, vinylbenzylaminotrimethoxysilane, (3,4-epoxycyclohexyl)ethyltrimethoxysilane, aminopropyltriphenoxysilane, aminopropyltribenzoyloxysilane, aminopropyltrifurfuroxysilane, aminopropyltri(o-chlorophenoxy)silane, aminopropyltri(p-chlorophenoxy)silane, aminopropyltri(tetrahydrofurfuroxy) silane, ureidosilane, mercaptoethyltriethoxysilane, and vinyltrichlorosilane, methacryloxypropyltri(2-methoxyethoxy)silane.

Other suitable silane coupling agents can include oligomeric aminoalkylsilanes having, as an amine-aldehyde resin-reactive group, two or more repeating aminoalkyl or alkylamino groups bonded in succession. An example of an oligomeric aminoalkylsilane is the solution Silane A1106, available under the trade name Silquest (GE Silicones-OSi Specialties, Wilton, Conn., USA), which is believed to have the general formula $(NH_2CH_2CH_2CH_2SiO_{1.5})_n$, where n is from 1 to about 3. Modified aminosilanes such as a triaminosilane solution (e.g., Silane A1128, available under the same trade name and from the same supplier) may also be used. Still other representative silane coupling agents can include the ureido substituted and amino substituted silanes such as ureidopropyltriethoxysilane, aminopropyltrimethoxysilane, and aminopropyltriethoxysilane.

Polysiloxanes and polysiloxane derivatives can also be used as coupling agents to prepare the modified amine-aldehyde resins. Polysiloxane derivatives include those polyorganosiloxanes obtained from the blending of organic resins with polysiloxane resins to incorporate various functionalities therein, including urethane, acrylate, epoxy, vinyl, and alkyl functionalities.

In at least one specific embodiment, the modified amine-aldehyde resin can include an amine-aldehyde resin that is the reaction product of a primary or a secondary amine and an aldehyde that has been modified with a coupling agent. In at least one other specific embodiment, the modified amine-aldehyde resin can include a urea-formaldehyde resin modified with a silane coupling agent. The urea-formaldehyde resin can have a molar ratio of urea to formaldehyde in the range of about 1:2 to about 1:3. In at least one other specific embodiment, the modified amine-aldehyde resin can include a urea-formaldehyde resin prepared by mixing formaldehyde, urea, triethanolamine and optionally ammonia reactants at an alkaline pH, heating the mixture to an elevated temperature for a time sufficient to obtain metholylation of the urea. The reactants can be present in an amount of about 1.5 to 4 moles of formaldehyde, about 0.001 to 0.1 mole of triethanolamine, and about 0 to 0.5 mole ammonia, per mole of urea. An acid can be added to lower the pH to within the range of about 4.9 to about 5.2, adding urea until the molar formaldehyde to urea ratio is within the range of about 1.5:1 to about 2.5:1, and reacting for a time sufficient to reduce free formaldehyde to less than 2%. A coupling agent, e.g., a silane coupling agent, can be added before, during, or after synthesis of the urea-formaldehyde resin. Suitable modified amine-aldehyde resins can include those discussed and described in U.S. Pat. Nos. 7,913,852; 8,011,514; and 8,092,686.

Considering the mixture of the polysaccharide and the resin having azetidinium functional groups and the polysaccharide cross-linked with the resin having azetidinium functional groups in more detail, the polysaccharide can include naturally-occurring and synthetic polymers of one or more types of saccharide monomers (e.g., glucose, fructose, galactose, etc.). The polysaccharides typically have at least 10 saccharide residues, and often several thousand residues (e.g., 2,000 to 14,000 residues). The polysaccharides can originate from a wide variety of natural and/or synthetic. For example, wood, seaweed, and bacteria, are known sources of the polysaccharides cellulose, alginate, and xanthan gum, respectively. As such, one illustrative group of polysaccharides can include cellulose and cellulosic polymers, starch, glycogen, amylopectin, guar gum, xanthan gum, dextran, carrageenan, alginate, chitin, chitosan, and hyaluronic acid. Additional "gum" polysaccharides include locust bean, plantago, and others.

The term "polysaccharide" also embraces the known derivatives that are readily obtained through the conversion, to various extents, of pendant hydroxyl groups, for example, to ethers and esters by reaction with alcohols and carboxylic acids, respectively. Similarly, derivatives having acidic groups, amino groups, sulfated amino, and added hydroxyl groups, etc., may be obtained according to known reactions. The extent to which various polysaccharide derivatives exhibit modified chemical properties, such as solubility and reactivity, is also known. Derivatives of polysaccharides also include their cationic and anionic salt forms. As is known in the art, conversion between two salt forms (e.g., between the soluble sodium or potassium salt forms and the insoluble calcium salt form of alginate) is often readily accomplished through ion exchange. As such, reference to a particular type of polysaccharide (e.g., cellulose) is meant to embrace its various chemically modified derivatives (e.g., carboxy methyl cellulose, hydroxy ethyl cellulose, cellulose acetate, methyl cellulose, etc.).

One example of a suitable polysaccharide is starch. Starches that can be used include various plant carbohydrates, such as barley starch, indian corn starch, rice starch, waxy maize starch, waxy sorghum starch, tapioca starch, wheat starch, potato starch, pearl starch, sweet potato starch, any derivatives thereof, or any mixture thereof. Examples of starch derivatives, often called converted or modified starches, include oxidized starches, hydroxyalkylated starches (e.g., hydroxyethylated corn starch), carboxyalkylated starches, various solubilized starches, enzyme-modified starches, acid-treated starches, thermo-chemically modified starches, etc. Starch derivatives also include chemically modified forms such as etherified or esterified derivatives. Many starch derivatives are cationic, anionic, or amphoteric. Cationic starches include dialdehyde starches, mannogalactan gum, and dialdehyde mannogalactan. Cationic starches can also be obtained from graft polymerization of cationic polymers, such as cationic polyacrylamide, onto the starch. Starches treated by a combination of the aforementioned processes also can be used, as can mixtures of the aforementioned starches.

The azetidinium functional groups, in resins that cross-link with the polysaccharide can be incorporated onto a variety of polymeric structures (i.e., a variety of polymer backbones) including polyethers; polyolefins (e.g., polypropylene); polyacrylamides; polystyrene that may be cross-linked, (e.g., with divinylbenzene); polymethacrylate and methacrylate co-polymers. These polymer backbones can themselves be polysaccharides (e.g., agarose or cellulose). Such azetidinium-functional resins are generally known to exhibit strong anion exchange capacity and are commercially available from a number of suppliers including Georgia-Pacific Chemicals LLC and Hercules, Inc.

The resin having azetidinium functional groups can be an adduct of an epoxide with a polyamine resin, a polyamidoamine resin, or a polyamide resin. Such resins can be made from glycidylether or epichlorohydrin condensates of polyalkylene polyamines and they can be water-soluble or water-dispersible. Illustrative commercially-available adducts of epoxides with polyamine resins, polyamidoamine resins, or polyamide resins include those sold under the names AMRES® (Georgia-Pacific Chemicals, LLC), as well as KYMENE® and REZOSOL® (Hercules, Inc.). Specific examples of such resins include AMRES-25 HP® (Georgia-Pacific Chemicals LLC), which is formed from the reaction product of epichlorohydrin and a polyamide, as well as KYMENE 557H® (Hercules, Inc.), which is formed from the reaction product of epichlorohydrin and poly(adipic acid-co-diethylenetriamine). An excess of epichlorohydrin can be used to control the rate of cross-linking during the manufacturing process and to aid in storage stability. Such compositions and processes for their manufacture are discussed and described, for example, in U.S. Pat. Nos. 2,926,116 and 2,926,154. Cationic polyazetidinium resins are known in the art as useful for imparting wet strength to paper and paper products.

Polyazetidinium resins, also known as polyamidoamine-halohydrin (or generally polyamide-halohydrin) resins, can be formed as reaction products of a polyamine or a polyamidoamine and a halohydrin (e.g., epichlorohydrin or epibromohydrin). Polyamidoamines, in turn, can be prepared from the reaction of a polyamine and a polyacid. Suitable polyamines can include, but are not limited to, polyalkylene polyamines such as diethylenetriamine or triethylenetetraamine. Other polyamines, such as those in the JEFFAMINE® family (Huntsman, LLC) can also be employed. Mixtures of polyamines are also applicable. Suitable polyacids include diacids such as succinic acid, adipic acid, oxalic acid, phthalic acid, etc. Depending on the molar ratio of the polyamine and polycarboxylic acid, the resulting polyamidoamine can retain predominantly primary amine groups or predominantly carboxylic acid groups at the terminal polymer ends. These termini can also have secondary or tertiary amine moieties. Details pertaining to the possible reactants that may be used to prepare polyamidoamines and the resulting polyamidoamine-halohydrin azetidinium resins, as well as the reaction conditions and synthesis procedures, can be as discussed and described in U.S. Pat. No. 2,926,154.

Various modified polyamidoamine-halohydrin resins, which can also be characterized as resins having azetidinium functional groups, are known in the art and are suitable for use in cross linking polysaccharides. For example, U.S. Pat. No. 5,585,456 describes linking the primary amine ends of polyamidoamine oligomers, synthesized as described above, by reaction with a dialdehyde (e.g., glyoxal). The resulting "chain-extended" polyamidoamine polymer is thereafter contacted with a halohydrin to react with the remaining available amine groups and thereby yield an aqueous polyazetidinium resin having hydrolyzable bonds in its polymer structure. Other modified forms of the cationic, water-soluble polyamidoamine-halohydrin resins useful as azetidinium-functional resins can include modified forms discussed and described in U.S. Pat. Nos. 3,372,086; 3,607,622; 3,734,977; 3,914,155; 4,233,411; and 4,722,964.

Aqueous binder compositions that can include a polysaccharide and a resin having azetidinium functional groups can also contain, in minor amounts on a dry solids basis, (1) additional cross linking agents, such as polyamines, polyamides, diisocyanates, polyols, or mixtures thereof; or (2) heat reactive resin components, such as an aldehyde-based resin, an isocyanate-based resin, or mixtures thereof. Combinations of these additives, such as a combination of (1) and (2) above, can also be employed. A broad range of weight ratios, on a dry solids basis, of azetidinium-functional resin to additive (or combined additives, when used in combination) may be employed. Typically, the additive(s), when used, can be present in an amount such that the ratio of azetidinium-functional resin dry solids weight:additive dry solids weight (or combined additive dry solids weight, when additives are used in combination), is from about 10:1 to about 3:2. Typically, this ratio can be from about 5:1 to about 2:1. For example, a polyacrylamide cross-linking agent may be added to the azetidinium-functional resin in a dry solids weight ratio of azetidinium-functional resin:polyacrylamide of 4:1. Alternatively, both a polyacrylamide cross-linking agent and a phenol-formaldehyde resin can be added to the azetidinium-functional resin in a dry solids weight ratio of azetidinium-functional resin:(polyacrylamide+phenol-formaldehyde) of 3:1. Various additional cross linking agents and heat reactive resins that may be added to azetidinium-functional resins, as well as their manner of addition, are described in detail in co-pending U.S. Patent Application Publication No.: 2007/0054144.

Both the polysaccharide and the resin having azetidinium functional groups, which can be used in the aqueous binder composition, can ay be combined to yield an aqueous solution or dispersion of these components. Thus, it is possible, for example, to add the polysaccharide (e.g., starch) as a solid to an aqueous solution or dispersion of the azetidinium-functional resin. In on example, the resin can have a dry solids content from about 5 wt % to about 80 wt %, or from about 5 wt % to about 75 wt %, or from about 20 wt % to about 65 wt %.

The dry solids content can be measured according to art-recognized methods for determining the solids (or non-volatiles) content of resins in general. That is, the dry solids or non-volatiles weight can be measured based on the weight of solids remaining after heating a small (e.g., 1-5 gram), sample of the solution or dispersion is heated at about 105° C. for about 3 hours. The balance of such a solution or dispersion may be water, optionally containing various additives known in the art to improve tack, viscosity, bonding strength, cure rate, moisture resistance, and other characteristics. Such additives can be as discussed and described in U.S. Patent Application Publication No.: 2007/0054144.

The azetidinium-functional resin can be added in a solid form such as a powder to an aqueous solution or dispersion of the polysaccharide, optionally containing the same additives as described above with respect to the aqueous solution or dispersion of the azetidinium-functional resin. The dry solids content of an aqueous solution or dispersion of the polysaccharide can range from about 5 wt % to about 50 wt %, or from about 10 wt % to about 35 wt %. Otherwise, solutions or dispersions of both the polysaccharide component and the azetidinium-functional resin component can be combined to prepare the aqueous binder composition. The initial forms of these components (i.e., whether in solution, dispersion, or solid forms) are therefore not critical. Regardless of these initial forms, in the resulting aqueous binder compositions, the dry solids content of the azetidinium-functional resin can be from about 0.1 wt % to about 10 wt % or from about 1 wt % to about 6 wt % of the dry solids content of the polysaccharide. The overall dry solids content of the aqueous binder composition will generally be in the ranges given above with respect to the dry solids content of the azetidinium-functional resin or the polysaccharide, when used in solution or dispersion form.

The mixture of the polysaccharide and the resin having azetidinium functional groups can also be cross linked or cured. For example, polysaccharide can be cross-linked with itself. In another example, the polysaccharide can be cross-linked with the resin having azetidinium functional groups. The cross-linked polysaccharides or polysaccharide/resin having azetidinium functional groups can be provided as an aqueous suspension, dispersion, or solution, which may be adjusted to the desired solids content. Otherwise, a solid form of this material can be prepared by drying or lyophilization, optionally followed by grinding if a smaller particle size material or a powder is desired. The powder form may be preferred in some instances, because of an extended storage life when properly stored. Solid particles of the cross-linked polysaccharide can also be prepared by spray drying. Irrespective of their form, the cross linked polysaccharides can be used in the same manner as the native polysaccharide (i.e., not cross linked with the azetidinium-functional resin).

In at least one specific embodiment, the mixture of the polysaccharide and the resin having azetidinium functional groups can have a resin dry solids content from about 0.1 wt % to about 10 wt % of the polysaccharide dry solids content and can be spray dried to provide an overall solids content of 5 wt % to 80 wt %, based on the combined weight of the polysaccharide dry solids and the resin dry solids. The polysaccharide and the resin having azetidinium functional groups can be cross-linked with one another. Suitable mixtures of the polysaccharide and the resin having azetidinium functional groups and the polysaccharide cross-linked with the resin having azetidinium functional group can be as discussed and described in U.S. Pat. No. 8,252,866.

Considering the Maillard reaction product in more detail, the Maillard reaction product the Maillard reaction product can be formed by reacting one or more amine reactants and one or more reducing sugars, one or more reducing sugar equivalents, or a mixture thereof. In its normal usage, a Maillard reaction is a chemical reaction between an amino acid (one category of an amine reactant) and a reducing sugar that often requires added heat to promote the reaction. It is known to involve a non-enzymatic browning where a reactive carbonyl group of the reducing sugar reacts with the nucleophilic amino group of the amino acid. The resulting products include a wide variety of poorly characterized molecular species, including certain high molecular weight heterogeneous polymers, generally identified as melanoidins.

Suitable amine reactants that can be used to Maillard reaction products can include almost any compound that has one or more reactive amino groups, i.e., an amino group available for reaction with a reducing sugar, a reducing sugar equivalent, or a mixture thereof. Compounds having (or which function as though they have) more than one reactive amino group can provide more flexibility in the synthesis of useful Maillard reaction products. Suitable reactive amino groups can be classified as a primary amino groups (i.e., —$NH_2$) and secondary amino groups (i.e., —NHR), where R can be any moiety that does not interfere with the Maillard reaction.

Illustrative amine reactants can include, but are not limited to, ammonia, hydrazine, guanidine, primary amines (e.g., compounds generally having the formula $NH_2R^1$), secondary amines (e.g., compounds generally having the formula $NHR^1R^2$), quaternary ammonium compounds (e.g., compounds generally having a group of the formula $(NH_4)^+$, $(NH_3R^1)^+$, and $(NH_2R^1R^2)^+$ and a related anion), polyamines (compounds having multiple primary and/or secondary nitrogen moieties (i.e., reactive amino groups) not strictly embraced by the foregoing formula), amino acids, and proteins, where $R^1$ and $R^2$ in the amines and quaternary ammonium compounds are each selected (independently in the case of $(NHR^1R^2)$ and $(NH^2R^1R^2)^+$) from hydroxyl, alkyl, alkenyl, alkynyl, cycloalkyl, aryl, heterocyclic, and heteroaryl groups (as discussed and described in more detail below).

"Alkyl" (monovalent) when used alone or as part of another term (e.g., alkoxy) means an optionally substituted branched or unbranched, saturated aliphatic hydrocarbon group, having up to 25 carbon atoms unless otherwise specified. Examples of particular unsubstituted alkyl groups include, but are not limited to, methyl, ethyl, n-propyl, isopropyl, n-butyl, iso-butyl, sec-butyl, tert-butyl, n-pentyl, 2-methylbutyl, 2,2-dimethylpropyl, n-hexyl, 2-methylpentyl, 2,2-dimethylbutyl, n-heptyl, 3-heptyl, 2-methylhexyl, and the like. The terms "lower alkyl", "$C_1$-$C_4$ alkyl" and "alkyl of 1 to 4 carbon atoms" are synonymous and used interchangeably to mean methyl, ethyl, 1-propyl, isopropyl, cyclopropyl, 1-butyl, sec-butyl or t-butyl. As noted, the term alkyl includes both "unsubstituted alkyls" and "substituted alkyls," (i.e., optionally substituted unless the context clearly indicates otherwise) the latter of which refers to alkyl moieties having substituents replacing one or more hydrogens on one or more (often no more than four) carbon atoms of the hydrocarbon backbone and generally only one substituent on one or two carbon atoms. Such substituents are independently selected from the group consisting of: halo (e.g., I, Br, Cl, F), hydroxy, amino, cyano, alkoxy (such as $C_1$-$C_6$ alkoxy), aryloxy (such as phenoxy), nitro, carboxyl, oxo, carbamoyl, cycloalkyl, aryl (e.g., aralkyls or arylalkyls), heterocyclic, and heteroaryl. Exemplary substituted alkyl groups include hydroxymethyl, aminomethyl, carboxymethyl, carboxyethyl, carboxypropyl, acetyl (where the two hydrogen atoms on the —$CH_2$ portion of an ethyl group are replaced by an oxo (=O), methoxyethyl, and 3-hydroxypentyl. Particular substituted alkyls are substituted methyl groups. Examples of substituted methyl group include groups such as hydroxymethyl, acetoxymethyl, aminomethyl, carbamoyloxymethyl, chloromethyl, carboxymethyl, carboxyl (where the three hydrogen atoms on the methyl are replaced, two hydrogens are replaced by an oxo (=O) and the other hydrogen is replaced by a hydroxy (—OH), bromomethyl and iodomethyl.

"Alkenyl" when used alone or as part of another term means an optionally substituted unsaturated hydrocarbon group containing at least one carbon-carbon double bond, typically 1 or 2 carbon-carbon double bonds, and which may be linear or branched. Representative alkenyl groups include, by way of example, vinyl, allyl, isopropenyl, but-2-enyl, n-pent-2-enyl, and n-hex-2-enyl. As noted, the term alkenyl includes both "unsubstituted alkenyls" and "substituted alkenyls," (i.e., optionally substituted unless the context clearly indicates otherwise). The substituted versions refer to alkenyl moieties having substituents replacing one or more hydrogens on one or more (often no more than four) carbon atoms of the hydrocarbon backbone and generally only one substituent on one or two carbon atoms. Such substituents are independently selected from the group consisting of: halo (e.g., I, Br, Cl, F), hydroxy, amino, alkoxy (such as $C_1$-$C_6$ alkoxy), aryloxy (such as phenoxy), carboxyl, oxo, cyano, nitro, carbamoyl, cycloalkyl, aryl (e.g., aralkyls), heterocyclic, and heteroaryl.

Alkynyl when used alone or as part of another term means an optionally substituted unsaturated hydrocarbon group containing at least one carbon-carbon triple bond, typically 1 or 2 carbon-carbon triple bonds, and which may be linear or branched. Representative alkynyl groups can include, but are not limited to, ethynyl; 1-, or 2-propynyl; 1-, 2-, or 3-butynyl, or 1,3-butdiynyl; 1-, 2-, 3-, 4-pentynyl, or 1,3-pentdiynyl; 1-, 2-, 3-, 4-, or 5-henynyl, or 1,3-hexdiynyl or 1,3,5-hextriynyl; 1-, 2-, 3-, 4-, 5- or 6-heptynyl, or 1,3-heptdiynyl, or 1,3,5-hepttriynyl; 1-, 2-, 3-, 4-, 5-, 6- or 7-octynyl, or 1,3-octdiynyl, and 1,3,5-octtriynyl. As noted, the term alkynyl includes both an unsubstituted alkynyl and a substituted alkynyl. The substituted versions refer to alkynyl moieties having substituents replacing one or more hydrogens on one or more (often no more than four) carbon atoms of the hydrocarbon backbone and generally only one substituent on one or two carbon atoms. Such substituents are independently selected from the group consisting of: halo (e.g., I, Br, Cl, F), hydroxy, amino, alkoxy (such as $C_1$-$C_6$ alkoxy), aryloxy (such as phenoxy), carboxyl, oxo, cyano, nitro, carbamoyl, cycloalkyl, aryl (e.g., aralkyls), heterocyclic, and heteroaryl.

"Cycloalkyl" when used alone or as part of another term means an optionally substituted saturated or partially unsaturated cyclic aliphatic (i.e., non-aromatic) hydrocarbon group (carbocycle group), having up to 12 carbon atoms unless otherwise specified and includes cyclic and polycyclic, including fused cycloalkyl. As noted, the term cycloalkyl includes both "unsubstituted cycloalkyls" and "substituted cycloalkyls," (i.e., optionally substituted unless the context clearly indicates otherwise) the latter of which refers to cycloalkyl moieties having substituents replacing one or more hydrogens on one or more (often no more than four) carbon atoms of the hydrocarbon backbone and generally only one substituent on one or two carbon atoms. Such substituents are independently selected from the group consisting of: halo (e.g., I, Br, Cl, F), hydroxy, amino, alkoxy (such as $C_1$-$C_6$ alkoxy), aryloxy (such as phenoxy), carboxyl, oxo, cyano, nitro, carbamoyl, alkyl (including substituted alkyls), aryl, heterocyclic, and heteroaryl. Examples of cycloalkyls include cyclopropyl, cyclobutyl, cyclopentyl, cyclohexyl, tetrahydronaphthyl and indanyl.

"Aryl" when used alone or as part of another term means an optionally substituted aromatic carbocyclic group whether or not fused having the number of carbon atoms designated or if no number is designated, from 6 up to 14 carbon atoms. Particular aryl groups include phenyl, naphthyl, biphenyl, phenanthrenyl, naphthacenyl, and the like (see e.g. Lang's Handbook of Chemistry (Dean, J. A., ed) 13.sup.th ed. Table 7-2 [1985]). As noted, the term aryl includes both unsubstituted aryls and substituted aryls, the latter of which refers to aryl moieties having substituents replacing one or more hydrogens on one or more (usually no more than six) carbon atoms of the hydrocarbon core and generally only one substituent on one or two carbon atoms. Such substituents are independently selected from the group consisting of: halo (e.g., I, Br, Cl, F), hydroxy, amino, alkoxy (such as $C_1$-$C_6$ alkoxy), aryloxy (such as phenoxy), carboxyl, oxo, cyano, nitro, carbamoyl, alkyl, aryl, heterocyclic and heteroaryl. Examples of such substituted aryls, e.g., substituted phenyls include but are not limited to a mono- or di(halo)phenyl group such as 2-chlorophenyl, 2-bromophenyl, 4-chlorophenyl, 2,6-dichlorophenyl, 2,5-dichlorophenyl, 3,4-dichlorophenyl, 3-chlorophenyl, 3-bromophenyl, 4-bromophenyl, 3,4-dibromophenyl, 3-chloro-4-fluorophenyl, 2-fluorophenyl; a mono- or di(hydroxy)phenyl group such as 4-hydroxyphenyl, 3-hydroxyphenyl, 2,4-dihydroxyphenyl, a mono- or di(lower alkyl)phenyl group such as 4-methylphenyl, 2,4-dimethylphenyl, 2-methylphenyl, 4-(iso-propyl)phenyl, 4-ethylphenyl, 3-(n-propyl)phenyl; a mono or di(alkoxy)phenyl group, for example, 3,4-dimethoxyphenyl, 3-methoxy-4-benzyloxyphenyl, 3-methoxy-4-(1-chloromethyl)benzyloxy-phenyl, 3-ethoxyphenyl, 4-(isopropoxy)phenyl, 4-(t-butoxy)phenyl, 3-ethoxy-4-methoxyphenyl; 3- or 4-trifluoromethylphenyl; a mono- or dicarboxyphenyl or (protected carboxy)phenyl group such 4-carboxyphenyl; a mono- or di(hydroxymethyl) phenyl or 3,4-di(hydroxymethyl)phenyl; a mono- or di(aminomethyl)phenyl or 2-(aminomethyl)phenyl. The aryl groups may have amine functionality (amino) such that the amine reactant is a diaminobenzene or diaminobenzene sulfonic acid, diaminotoluene, diaminonaphthalene, diaminonaphthalene sulfonic acid, and numerous others.

"Heterocyclic group", "heterocyclic", "heterocycle", "heterocyclic", "heterocycloalkyl" or "heterocyclo" alone and when used as a moiety in a complex group, are used interchangeably and refer to any cycloalkyl group, i.e., mono-, bi-, or tricyclic, saturated or unsaturated, non-aromatic and optionally substituted hetero-atom-containing ring systems having the number of atoms designated, or if no number is specifically designated then from 5 to about 14 atoms, where the ring atoms are carbon and at least one heteroatom and usually not more than four (nitrogen, sulfur or oxygen). Included in the definition are any bicyclic groups where any of the above heterocyclic rings are fused to an aromatic ring (i.e., an aryl (e.g., benzene) or a heteroaryl ring). In a particular embodiment the group incorporates 1 to 4 heteroatoms. Typically, a 5-membered ring has 0 to 1 double bonds and 6- or 7-membered ring has 0 to 2 double bonds and the nitrogen or sulfur heteroatoms may optionally be oxidized (e.g., SO, $SO_2$), and any nitrogen heteroatom may optionally be quaternized. Particular non-aromatic heterocycles include morpholinyl(morpholino), pyrrolidinyl, oxiranyl, indolinyl, isoindolinyl, tetrahydroquinolinyl, tetrahydroisoquinolinyl, oxetanyl, tetrahydrofuranyl, 2,3-dihydrofuranyl, 2H-pyranyl, tetrahydropyranyl, aziridinyl, azetidinyl, 1-methyl-2-pyrrolyl, piperazinyl and piperidinyl. As noted, the term heterocyclo includes both "unsubstituted heterocyclos" and "substituted heterocyclos"

(i.e., optionally substituted unless the context clearly indicates otherwise), the latter of which refers to heterocyclo moieties having substituents replacing one or more hydrogens on one or more (usually no more than six) atoms of the heterocyclo core and generally only one substituent on one or two carbon atoms. Such substituents are independently selected from the group consisting of: halo (e.g., I, Br, Cl, F), hydroxy, amino, alkoxy (such as $C_1$-$C_6$ alkoxy), aryloxy (such as phenoxy), carboxyl, oxo, cyano, nitro, carbamoyl, and alkyl.

"Heteroaryl" alone and when used as a moiety in a complex group refers to any aryl group, i.e., mono-, bi-, or tricyclic, optionally substituted aromatic ring system having the number of atoms designated, or if no number is specifically designated then at least one ring is a 5-, 6- or 7-membered ring and the total number of atoms is from 5 to about 14 and containing from one to four heteroatoms selected from the group consisting of nitrogen, oxygen, and sulfur (Lang's Handbook of Chemistry, supra). Included in the definition are any bicyclic groups where any of the above heteroaryl rings are fused to a benzene ring. The following ring systems are examples of the heteroaryl (whether substituted or unsubstituted) groups denoted by the term "heteroaryl": thienyl (alternatively called thiophenyl), furyl, imidazolyl, pyrazolyl, thiazolyl, isothiazolyl, oxazolyl, isoxazolyl, triazolyl, thiadiazolyl, oxadiazolyl, tetrazolyl, thiatriazolyl, oxatriazolyl, pyridyl, pyrimidyl, pyrazinyl, pyridazinyl, thiazinyl, oxazinyl, triazinyl, thiadiazinyl, oxadiazinyl, dithiazinyl, dioxazinyl, oxathiazinyl, tetrazinyl, thiatriazinyl, oxatriazinyl, dithiadiazinyl, imidazolinyl, dihydropyrimidyl, tetrahydropyrimidyl, tetrazolo[1,5-b] pyridazinyl and purinyl, as well as benzo-fused derivatives, for example benzoxazolyl, benzofuryl, benzothienyl, benzothiazolyl, benzothiadiazolyl, benzotriazolyl, benzoimidazolyl and indolyl. As noted, the term heteroaryl includes both unsubstituted heteroaryls and substituted heteroaryls, the latter of which refers to heteroaryl moieties having substituents replacing one or more hydrogens on one or more (usually no more than six) atoms of the heteroaryl backbone. Such substituents are independently selected from the group consisting of: halo (e.g., I, Br, Cl, F), hydroxy, amino, alkoxy (such as $C_1$-$C_6$ alkoxy), aryloxy (such as phenoxy), carboxyl, oxo, cyano, nitro, carbamoyl, and alkyl.

"Amino" denotes primary (i.e., —$NH_2$), secondary (i.e., —NHR) and tertiary (i.e., —NRR) amine groups, where the R groups can independently be selected moieties, usually an alkyl or an aryl. Particular primary, secondary, and tertiary amines can include alkylamine groups, dialkylamine groups, arylamine groups, diarylamine groups, aralkylamine groups and diaralkylamine groups.

Suitable primary, secondary and polyamines amines for use as the amine reactant can include, but are not limited to, methylamine, ethylamine, propylamine, isopropylamine, ethyl propylamine benzylamine dimethylamine, diethylamine, dipropylamine, caprylamine, palmitylamine, dodecylamine, heptylamine, stearylamine, ethylene diamine, diethylene triamine, triethylene tetraamine, tetraethylene pentamine, cadaverine, putrescine, spermine, spermidine, histamine, piperidine, ethanolamine, diethanolamine, aminoethylpiperazine, piperazine, morpholine, aniline, 1-naphthylamine, 2-napthylamine, para-aminophenol, diaminopropane, diaminodiphenylmethane, allylamine, cysteamine, aminoethylethanol amine, isopropanolamine, toluidine, Jeffamines, aminophenol, guanidine, aminothiourea, diaminoisophorone, diaminocyclohexane, dicyandiamide, amylamine, hexamethylenediamine, bis-hexamethylenediamine, polyvinylamine, polyallylamine, cyclohexylamine, xylylenediamine disopropylamine, aminoethylaminopropyltrimethoxysilane, aminopropyltriethoxysilane, aminoethylaminopropyltrimethoxysilane, aminoethylaminopropyltrimethoxysilane, aminoethylaminopropylsilane triol homopolymer, vinylbenzylaminoethylaminopropyltrimethoxysilane, aminopyridine, aminosalicylic acid, aminophenol, aminothiophenol, aminoresorcinol, bis(2-chloro ethyl)amine, aminopropanediol, aminopiperidine, aminopropylphosphonic acid, amino(ethyl sulfonyl) phenol, amino ethylmorpholine, amino ethylthiadiazole, amino ethyl hydrogen sulfate, aminopropylimidazole, aminoethylacrylate, polymerized aminoethylacrylate, aminoethylmethacrylate, polymerized aminoethylmethacrylate, the condensation polymers and oligomers of diacids and polyacids with triamines and higher polyamines like diethylene triamine and triethylene tetraamine. Other amine reactants can include furfurylamine, dipropylene triamine (available from Air Products), tripropylene tetramine (available from Air Products), tetrapropylene pentamine (available from Air Products), the reaction products of amines with formaldehyde including hexamethylene tetraamine, N,N,N-tri(hydroxyethyl)triazine, triazone, low molecular weight amino esters like aminoethylacetate, aminopropylacetate, aminoethylformate, aminopropylformate, aminoethylproprionate, aminopropylproprionate, aminoethylbutyrate, aminopropylbutyrate, aminoethylmaleate, di(aminoethylmaleate), fatty aminoesters like aminoethyltallate, the aminopropyl ester of all fatty acids, fatty acid dimers, oxidized fatty acids, maleated fatty acid, and oxidized-maleated fatty acids, and the aminoethyl ester of all fatty acids, fatty acid dimers, oxidized fatty acids, maleated fatty acid, and oxidized-maleated fatty acids, particularly when the fatty acid is tall oil fatty acid (TOFA). Polyamino esters like the polymer of aminoethylacrylate, the polymer of aminoethylmethacrylate, the polymer of aminopropylacrylate, the polymer of aminopropylmethacrylate, and all other polycarboxylic acids that have been exhaustively esterfied with ethanolamine (done under acid conditions to selectively form the ester over the amide.)

Other suitable amine reactants can include amido amine reactions products having residual reactive amino groups of a diamine or polyamine with a carboxylic acid or a mixture of carboxylic acids such as rosin acid, maleated rosin, maleated unsaturated fatty acids, oxidized unsaturated fatty acids, oxidized maleated unsaturated fatty acids, unsaturated fatty acid dimers and trimers, particularly when the fatty acid is TOFA.

Suitable amine reactants can also include natural and/or synthetic amino acids, i.e., compounds having both reactive amino and acid (carboxyl) functional groups. Suitable amino acids thus would include biogenic amino acids such as alanine, aminobutyric acid, arginine, asparagine, aspartic acid, cysteine, cystine, dibromotyrosine, diidotyrosine, glutamic acid, glutamine, histidine, homocysteine, hydroxylysine, hydroxyproline, isoleucine, leucine, lysine, methionine, ornithine, phenylalanine, proline, sarcosine, serine, threonine, thyroxine, tryptophane, tyrosine, and valine, and all potential dimers, oligimers and polymers made from such amino acids. Synthetic amino acids including aminobenzoic acid, aminosalicylic acid, aminoundecanoic acid and all potential dimers, oligomers and polymers made from them are likewise suitable raw materials (amine reactants) for producing a Maillard reaction product by the Maillard reaction. Higher molecular weight amine reactants include peptides and proteins including gluten, whey, glutathione, hemoglobin, soy protein, collagen, pepsin, keratin, and casein as these materials can also participate in the Maillard reaction.

Other suitable synthetic amino acid-type amine reactants can be formed by reacting a polyamine with a polycarboxylic acid or a mixture of polycarboxylic acids. The reaction between the polyamine and the acid can be performed prior to, or coincident with the Maillard reaction. Suitable polycarboxylic acids for forming a synthetic amino acid-type amine reactant by reaction with a polyamine include, but are not limited to monomeric polycarboxylic acids and/or polymeric polycarboxylic acids. Such polycarboxylic acids include dicarboxylic acids, tricarboxylic acids, tetracarboxylic acids, pentacarboxylic acids, and higher carboxyl functionality. Certain polycarboxylic acids also may be used in their anhydride form.

The polycarboxylic acids can be made of the following: unsaturated aliphatic acids, saturated aliphatic acids, aromatic acids, unsaturated carbocyclic acids, and saturated carbocyclic acids, all of which might be optionally substituted, with hydroxy, halo, alkyl, and alkoxy groups. Representative monomeric polycarboxylic acids thus include, but are not limited to, citric acid, aconitic acid, adipic acid, azelaic acid, butane tetracarboxylic acid dihydride, butane tricarboxylic acid, chlorendic acid, citraconic acid, dicyclopentadiene-maleic acid adducts, diethylenetriamine pentaacetic acid, adducts of dipentene and maleic acid, adducts of olefins and maleic acids, ethylenediamine tetraacetic acid (EDTA), maleated rosin, maleated, unsaturated fatty acids including maleated tall oil fatty acid, oxdized unsaturated fatty acids including oxidized tall oil fatty acid, oxidized maleated unsaturated fatty acids including oxidized and maleated tall oil fatty acid, unsaturated fatty acid dimer and trimers (including TOFA dimers and trimers), fumaric acid, glutaric acid, isophthalic acid, itaconic acid, maleated rosin oxidized with potassium peroxide to alcohol then carboxylic acid, maleic acid, malic acid, mesaconic acid, biphenol A or bisphenol F reacted via the KOLBE-Schmidt reaction with carbon dioxide to introduce 3-4 carboxyl groups, oxalic acid, phthalic acid, sebacic acid, succinic acid, tartaric acid, terephthalic acid, tetrabromophthalic acid, tetrachlorophthalic acid, tetrahydrophthalic acid, trimellitic acid, polyacrylic acid, polymethacrylic acid, polyaspartic acid, aspartic acid, ascorbic acid, glucaric acid, styrene maleic acid copolymers, styrene fumaric acid copolymers, polyitaconic acid, adipic acid, glutamic acid, malonic acid, malic acid, polycrotonic acid, humic acid, sorbic acid, and trimesic acid.

Possible polymeric polycarboxylic acids can be equally expansive and can include homopolymers and/or copolymers prepared from unsaturated carboxylic acids including, but not limited to, acrylic acid, methacrylic acid, crotonic acid, isocrotonic acid, maleic acid, cinnamic acid, 2-methylmaleic acid, itaconic acid, 2-methylitaconic acid and alpha, beta-methyleneglutaric acid. Suitable polymeric polycarboxylic acids also may be prepared from unsaturated anhydrides including, but not limited to, maleic anhydride, itaconic anhydride, acrylic anhydride, and methacrylic anhydride. Non-carboxylic vinyl monomers, such as styrene, alpha-methylstyrene, acrylonitrile, methacrylonitrile, methyl acrylate, ethyl acrylate, n-butyl acrylate, isobutyl acrylate, methyl methacrylate, n-butyl methacrylate, isobutyl methacrylate, glycidyl methacrylate, vinyl methyl ether and vinyl acetate, also may be copolymerized with above-noted carboxylic acid monomers to form suitable polymeric polycarboxylic acids. Methods for polymerizing these monomers are well-known in the chemical art.

Suitable polymeric polycarboxylic acids also can include certain polyester adducts of a polycarboxylic acid, such as those mentioned above, and a polyol. Suitable polyols can include, but are not limited, for example, to ethylene glycol, glycerol, pentaerythritol, trimethylol propane, sorbitol, sucrose, glucose, resorcinol, catechol, pyrogallol, glycollated ureas, 1,4-cyclohexane diol, diethanolamine, triethanolamine, bis-[N,N-di(.beta.-hydroxyethyl)]adipamide, bis[N,N-di(.beta.-hydroxypropyl)]azelamide, bis[N,N-di(.beta.-hydroxypropyl)]adipamide, bis[N,N-di(.beta.-hydroxypropyl)]glutaramide, bis[N,N-di(.beta.-hydroxypropyl)]succinamide, bis[N-methyl-N-(.beta.-hydroxyethyl)]oxamide, polyvinyl alcohol, a partially hydrolyzed polyvinyl acetate, and homopolymers or copolymers of hydroxyethyl(meth)acrylate, and hydroxypropyl (meth)acrylate. The polyester adduct must contain at least two carboxylic acid groups or anhydride or salt equivalents thereof. Methods for making such polyesters are well-known Another category of suitable amine reactants can be adducts of ammonia (typically supplied as an aqueous solution), primary amines, and/or secondary amines pre-reacted (or reacted in situ) with monomeric polycarboxylic acids and/or polymeric polycarboxylic acids to produce the respective ammonium salts of the acid or mixture of acids. While ammonia can conveniently be used, any reactive amine, including any primary or secondary amine suitable for reacting with monomeric polycarboxylic acid and/or a polymeric polycarboxylic acid also could be used. Thus, ammonium salts produced by neutralizing polycarboxylic acid(s)s with ammonia, or with a primary or secondary amine including those ammonium salts produced by a less-than-complete neutralization are considered suitable for use as an amine reactant for making a Maillard reaction product. In such instances, the neutralization of the acid groups of the polycarboxylic acid(s) also can be carried out either before or after the reducing sugar, or equivalent thereof is added for forming the Maillard reaction product.

The reducing sugar or equivalent thereof can include any monosaccharide and/or maltose and/or lactose. Illustrative monosaccharides can include, but are not limited to, glyceraldehyde, dihydroxyacetone, erythrose, threose, erythrulose, ribose, arabinose, xylose, lyxose; ribulose, arabulose, xylulose, lyxulose, glucose (i.e., dextrose), mannose, galactose, allose, altrose, talose, gulose, idose; fructose, psicose, dendroketose, aldotetrose, aldopentose, aldohexose, sorbose, tagatose, sedoheptulose, or any mixture thereof.

Without wishing to be bound by theory, it is believed that that molecules produced by a Maillard reaction may include a general structure comprising a backbone of carbon atoms with an occasional nitrogen atom, possibly long stretches of conjugated double bonds, and possibly highly hydrophilic side chains due to hydroxy groups being substituted on many of the carbon atoms (See "Isolation and Identification of Nonvolatile. Water Soluble Maillard Reaction Products," Thesis, Eva Kaminski, McGill University 1997). At least some nitrogen atoms are thought to be double bonded to one carbon in the backbone and the existence of carbon side chains substituted on some of the nitrogen atoms makes some of the nitrogen atoms quaternary, thus often introducing some cationic character to the molecules.

Melanoidins typically display an atomic C:N ratio, degree of unsaturation, and chemical aromaticity that increase with temperature and time of heating. (See, Ames, J. M. in "The Maillard Browning Reaction—an update," Chemistry and Industry (Great Britain), 1988, 7, 558-561). Accordingly, Maillard reaction products can contain melanoidins, or other Maillard reaction products.

One or more non-carbohydrate polyhydroxy reactant can be reacted along with the reducing sugar or equivalent when preparing the Maillard reaction product. Non-limiting examples of non-carbohydrate polyhydroxy reactants can include, but are not limited to, trimethylolpropane, glycerol, pentaerythritol, partially hydrolyzed polyvinyl acetate, fully hydrolyzed polyvinyl acetate (i.e., polyvinyl alcohol), and mixtures thereof.

The Maillard reaction product can be produced by mixing the amine reactant and the reducing sugar and/or the reducing sugar equivalent under conditions conducive for a Maillard reaction. The reaction can be conducted in an aqueous medium and generally proceeds under a range of pH conditions, though an acidic pH is most commonly employed. Depending on the specific reactants chosen, the reaction can proceed under ambient conditions or with mild heating to initiate the reaction. In one example, the reaction can be conducted in an aqueous medium under refluxing conditions has proven to be suitable. Generally, the reaction is sufficiently exothermic that once initiated, it may not be necessary to supply any additional heating such that the reaction system becomes self-refluxing.

While the relative quantities of the amine reactant and the reducing sugar and/or the reducing sugar equivalent can be varied depending on particular circumstances, for the most part preparing the Maillard reaction product at a relative ratio of the moles of the reducing sugar (or reducing sugar equivalent) to moles of amine functional groups (reactive amino groups) in the amine reactant within the range of 1:1 to 3:1 should be suitable. For example, reactant mixture for preparing the Maillard reaction product can include an aqueous mixture of an amine reactant, such as ammonia, a polycarboxylic acid, e.g., citric acid, and a reducing sugar, i.e., dextrose, provided in a molar ratio of moles ammonia to moles citric acid to moles dextrose of about 3.3:1:6. In this case, a slight excess amount of ammonia (about 10%) designed to completely neutralize the citric acid can be present. Nonetheless, the volatility of the ammonia can prevent full or complete neutralization of the citric acid during the formation of the Maillard reaction product.

The extent of the Maillard reaction occurs can be controlled. The exact desired end point of the reaction forming the Maillard reaction product can vary depending on its intended end use and can be influenced by a variety of factors, such as the particular reactants chosen, the reactant concentrations, the reaction temperature, pH, time, etc. A skilled worker, armed with the disclosure of this application, through the exercise of only routine testing will be able to identify a suitable set of conditions for producing a suitable Maillard reaction product to be used as an adjuvant for a particular application, including a specific separation process. The Maillard reaction product can be made from aqueous ammonia, citric acid and dextrose, heating the aqueous mixture to atmospheric reflux, removing the heat and then allowing it to cool to room (ambient) temperature has resulted in a suitable product for use as a depressant.

The pH of the Maillard reaction product in an aqueous medium may vary from acidic, i.e., a pH less than 7, for example between 2 and 6, to an alkaline pH, i.e., a pH greater than 7, for example between 8 and 12, depending on the specific types and amounts of the various reactants. The Maillard reaction product can be neutralized, i.e., formed into a salt of such acidic and alkaline Maillard reaction products using an appropriate base or acid depending on the pH of the reaction product. Such neutralized products can also be used as the depressant in a separation process discussed and described herein. Suitable Maillard reaction products can include those discussed and described in U.S. Patent Application Publication No.: 2009/0301972.

In the purification of certain ores or other value material, e.g., clay, it can be advantageous to employ a flocculant such as polyacrylamide and/or oils to control frothing. Other suitable flocculants can include, but are not limited to, copolymers of polyacrylamide and acrylic acid, polyacrylates, acrylonitrites, N-substituted acrylamides, sulfonated polystyrene, sulfonated polyethyleneimine, carboxymethylcelluloses, anionic starches, sulfonated urea-formaldehyde resins, sulfonated melamine-formaldehyde resins, sulfonated phenol-formaldehyde resins, sulfonated urea-melamine-formaldehyde resins, styrene-maleic anhydride polymers, lignosulfonates, humic acids, tannic acids, sulfated castor oil, sodium docecylsulfonate, adipic acid, azuleic acid, or any mixture thereof.

In the purification of certain ores or other value material, e.g., clay, it can be advantageous to employ a frothing agent that can promote the formation of a suitably structured froth. Illustrative frothing agents can include, but are not limited to, pine oils, cresol, 2-ethyl hexanols, aliphatic alcohols such as isomers of amyl alcohol and other branched $C_4$ to $C_8$ alkanols, polypropylene glycols, ethers, methyl cyclohexyl methanols, or any combination thereof. Particularly suitable frothing agents can include, but are not limited to, methyl isobutyl carbinol (MIBC), polypropylene glycol alkyl, and/or phenyl ethers. The amount of the frothing agent added to the mixture containing the ore or other value material and the one or more contaminants can range from a low of about 0.001 wt %, about 0.01 wt %, about 0.1 wt %, or about 0.2 wt % to a high of about 0.3 wt %, about 0.5 wt %, or about 1 wt %, based on the weight of the solids in the mixture.

EXAMPLES

In order to provide a better understanding of the foregoing discussion, the following non-limiting examples are offered. Although the examples may be directed to specific embodiments, they are not to be viewed as limiting the invention in any specific respect. All parts, proportions, and percentages are by weight unless otherwise indicated.

A series of froth flotation experiments (Examples 1-6) separating a phosphate ore were conducted. For all examples the phosphate ore was ground to a powder, with 80 wt % of the phosphate ore powder having a particle size finer than 75 μm.

Example 1

The phosphate ore powder in an amount of 50 g was mixed with 33.3 g water to produce a 60 wt % solids mixture. To the mixture was added a 30 wt % aqueous solution of sodium carbonate to adjust the pH of the mixture to 11 and the mixture was stirred for 2 minutes. To the mixture 0.35 g (7 kg/tonne) of a 40 wt % aqueous solution of sodium silicate (dispersant) was added to the mixture and the mixture was stirred for another 2 minutes. The mixture was treated with 0.15 g of tall oil fatty acid (3 kg/tonne) as a collector and the mixture was stirred for another 3 minutes. Water (950 g) was added to the mixture to provide a diluted mixture containing 5 wt % solids.

Example 2

The phosphate ore powder in an amount of 50 g was mixed with 33.3 g water to produce a 60 wt % solids mixture. To the mixture was added a 30 wt % aqueous solution of sodium carbonate to adjust the pH of the mixture to 11 and the mixture was stirred for 2 minutes. To the mixture 0.013 g (0.25 kg/tonne) of a cationic polymer (depressant) was added and the mixture was stirred for 3 minutes. The mixture was treated with 0.15 g of tall oil fatty acid (3 kg/tonne) as the collector and the mixture was stirred for another 3 minutes. Water (950 g) was added to the mixture to provide a diluted mixture containing 5 wt % solids.

The cationic polymer used in Example 2 (and Examples 3-6 discussed below) was prepared according to the following procedure. UFC 85 (42.8 parts by weight ("pbw")) and a 50% by weight aqueous formaldehyde solution (21.2 pbw) were added to a reactor, the temperature of the aqueous mixture was adjusted to 50° C., and mixing was initiated and maintained throughout the remainder of the process. An 8% by weight aqueous sulfuric acid solution (0.22 pbw) followed by a 28% by weight aqueous solution of ammonia (12.8 pbw) were added to the reactor. An exothermic reaction caused the temperature to increase and with additional heating the temperature was increased to about 80° C., held at that temperature for five (5) minutes and then cooled to a temperature of 60° C. After cooling, 17.6 pbw of prilled urea was added along with 4.7 pbw of guanidine carbonate. The pH of the reaction mixture was about 10. An exothermic reaction caused the temperature to increase and with additional heating the temperature was increased to 97° C. The reaction was continued at this temperature and the extent of the reaction was monitored by periodically measuring viscosity. The viscosity was initially measured to be between A1 and A2 on Gardner-Holt scale at the point the reaction mixture reached 97° C. An additional 0.45 pbw of 8% by weight sulfuric acid was added, but because the viscosity was less than desired, it was followed by two separate additions of 3.3 pbw each of a 20% by weight solution of sulfuric acid about 30 minutes later. Another two charges of sulfuric acid (20% by weight solution) constituting 0.33 pbw and 0.57 pbw, respectively, were added to the reactor, with the final addition of the sulfuric acid occurring about 2.5 hours after the synthesis began. After the last addition of the sulfuric acid, the pH of the reaction mixture was about 5 and the viscosity was approximately G on the Gardner-Holt scale. The reaction mixture was then cooled to about 80° C. A 50% by weight aqueous solution of sodium hydroxide was added (0.03 pbw) and the reaction mixture was vacuum distilled to yield (about 3 hours after the start of the synthesis) a cationic polymer solution that had a Brookfield viscosity at 25° C. of 433 cps and a percent solids content of about 60% by weight. The water dilute of the aqueous cationic polymer product should be greater than 10 to 1. The Brookfield viscosity was measured at 25° C. using a Digital Viscometer with a small sample adapter (Model DV-II) at 50 rpms.

Examples 3-6

Similar to Examples 1 and 2, the phosphate ore powder in an amount of 50 g was mixed with water to produce a 60 wt % solids mixture and the pH of each mixture was adjusted to 11 with the 30 wt % aqueous sodium carbonate and stirred for 2 minutes. A combination of the 40 wt % aqueous solution of sodium silicate (dispersant) and the cationic polymer (depressant) were added to the mixtures with the sodium silicate added first, followed by 2 minutes of stirring, and the cationic polymer added second, followed by another 3 minutes of stirring. The amount of the sodium silicate added to the mixture in Examples 3-6 was 0.15 g (3 kg/tonne), 0.25 g (5 kg/tonne), 0.35 g (7 kg/tonne), and 0.45 g (9 kg/tonne), respectively. The amount of the cationic polymer added to the mixtures in examples 3-6 was 0.013 g (0.25 kg/tonne) for all four examples. Each mixture was diluted with 950 g of water to provide diluted mixtures containing 5 wt % solids.

The diluted mixtures prepared in Examples 1-6 were each placed in a Denver cell and stirred for 30 seconds before opening the air port. Frothing ensued as the air was introduced into the cell and the froth was collected for 2 minutes. The froth concentrate and the tailings remaining in the Denver cell were then separately filtered, dewatered, weighed and analyzed for phosphate content using inductively coupled plasma (ICP) and for acid insoluble content using acid digestion as is customary in phosphate flotation.

TABLE 1

Froth Flotation of Phosphate Ore

| Example | Sodium Silicate (kg/tonne) | Cationic Polymer (kg/tonne) | Yield (%) | Phosphate Recovery (%) | Acid Insolubles Rejection (%) | Sep. Eff. (%) | Concentrate Grade (%) |
|---|---|---|---|---|---|---|---|
| Ex. 1 | 7 | 0 | 38.6 | 47.8 | 68.36 | 16.17 | 25.32 |
| Ex. 2 | 0 | 0.25 | 59 | 65.12 | 49.56 | 14.68 | 24 |
| Ex. 3 | 3 | 0.25 | 50.4 | 60.57 | 61.98 | 22.56 | 26.2 |
| Ex. 4 | 5 | 0.25 | 34.2 | 41.93 | 69.86 | 11.79 | 25.62 |
| Ex. 5 | 7 | 0.25 | 30.1 | 36.31 | 75.32 | 11.63 | 24.69 |
| Ex. 6 | 9 | 0.25 | 37.2 | 41.25 | 66.43 | 7.68 | 22.82 |

Table I shows a surprising and unexpected synergistic effect was obtained by using both the dispersant and the depressant. While the data in Table I is not be optimized, it is apparent that the optimal amount of sodium silicate, when used in combination with the depressant, is significantly lower than when used alone. For example, sodium silicate without the cationic polymer (Ex. 1) used in an amount of 7 kg/tonne yielded a phosphate recovery of 47.8% and a grade of 25.32%. When 0.25 kg/tonne of the cationic polymer was added along with the 7 kg/tonne of sodium silicate (Ex. 5) both recovery and grade are decreased. As the amount of sodium silicate decreased (when the cationic polymer was kept at 0.25 kg/tonne), however, the grade increased up to the 26.2% when only 3 kg/tonne of the sodium silicate was present (Ex. 3). Accordingly, from the data available in Table 1, it is readily apparent that the amount of sodium silicate can be decreased by about 57%, while at the same time a significant increase in grade and phosphate recovery was achieved.

The separation efficiency shown in Table 1 above was determined according to the following equation:

$$\text{Sep. Eff.}=[\%\ \text{Phosphate Recovery}-(100-\%\ \text{Acid Insolubles Rejection})]$$

As shown in Table 1 above, surprisingly and unexpectedly a significant increase in the separation efficiency of the process was observed in Example 3. More particularly, the separation efficiency increased from 16.17% (Ex. 1), which included only the sodium silicate, to 22.56% when the cationic polymer was added in an amount of only 0.25 kg/tonne. Additionally, the amount of sodium silicate required to achieve this significant increase in separation efficiency required about 57% less sodium silicate. In other words, not only was a significant reduction in the amount of sodium silicate (dispersant) required for the separation achieved by adding a small amount of the cationic polymer (depressant), a significant increase in separation efficiency was also achieved.

In addition to the improvement in separation efficiency, when performing the separations in Examples 1-3, it was noted that the froth quality was dependent on the flotation chemicals being employed. In froth flotation the separation of the floated material and the material left behind is dependent, at least in part, on the formation of a froth layer having sufficient integrity to allow for removal of the froth by physical means such as using a hand-held paddle in laboratory experiments or a rotating mechanical paddle in an industrial separation process. If the froth does not have sufficient strength, the floated materials may sink, and the separation is reversed. On the other hand, if the froth is too stable, the bubbles on the surface may become so large that they are unmanageable, and the froth may spill out of the flotation cell. When conducting the separations in Examples 1-3 it was noted that the use of the cationic polymer alone (Ex. 2) lead to formation of a froth layer that was very stable, had large bubbles, and was difficult the lab personnel to collect. The use of sodium silicate alone (Ex. 1) resulted in a more manageable froth. Example 3 that included both the sodium silicate and the cationic polymer, resulted in a stable froth with larger bubbles than in the case of sodium silicate alone (Ex. 1), but not as stable and difficult to manage as when the cationic polymer was used alone in (Ex. 2). As such, not only is the separation efficiency improved with the use of the cationic collector, the presence of the cationic polymer also appears to improve the froth quality.

It should be noted that, the same conditioning time, i.e., 3 minute mixing time, for the cationic polymer (depressant) in Examples 2-6 was used and the same conditioning time, i.e., 2 minute mixing time, for the sodium silicate (dispersant) in Examples 1 and 3-6 was used. These conditioning times, however, were not necessarily optimized, and it is expected that there may be a minimum conditioning time that may be required to achieve the surprising and unexpected improvement in the separation process shown in Table 1. It is also expected that different ores with different types of clays, different clay contents, or other impurities may require different conditioning times.

Embodiments of the present disclosure further relate to any one or more of the following paragraphs:

1. A method for purifying a value material, comprising: contacting an aqueous mixture comprising a value material and a contaminant with a dispersant and a depressant to produce a treated mixture, wherein a weight ratio of the dispersant to the depressant is from about 1:1 to about 30:1, and wherein: the dispersant comprises silica, a silicate, a polysiloxane, a starch, a modified starch, a gum, a tannin, a lignosulphonate, carboxyl methyl cellulose, a cyanide salt, a polyacrylic acid based polymer, a naphthalene sulfonate, a benzene sulfonate, a pyrophosphate, a phosphate, a phosphonate, a tannate, a polycarboxylate polymer, a polysaccharide, dextrin, a sulfate, or any mixture thereof, and the depressant comprises an amine-aldehyde resin, an amine-aldehyde resin modified with a silane coupling agent, a Maillard reaction product, a mixture of one or more polysaccharides and one or more resins having azetidinium functional groups, a polysaccharide cross-linked with one or more resins having azetidinium functional groups, or any mixture thereof; and recovering a purified product comprising the value material from the treated mixture, wherein the purified product has a reduced concentration of the contaminant relative to the aqueous slurry.

2. The method according to paragraph 1, wherein the weight ratio of the dispersant to the depressant is from about 9:1 to about 15:1.

3. The method according to paragraph 1 or 2, wherein the value material comprises phosphorus, lime, sulfates, gypsum, iron, platinum, gold, palladium, cobalt, barium, antimony, bismuth, titanium, molybdenum, copper, uranium, chromium, tungsten, manganese, magnesium, lead, zinc, rare earth elements, clay, coal, silver, graphite, nickel, bauxite, borax, borate, carbonates, a heavy hydrocarbon, or any mixture thereof.

4. The method according to any one of paragraphs 1 to 3, wherein the value material comprises a phosphorus containing ore, and wherein the phosphorus containing ore comprises triphylite, monazite, hinsdalite, pyromorphite, vanadinite, erythrite, amblygonite, lazulite, wavellite, turquoise, autunite, carnotite, phosphophyllite, struvite, one or more apatites, one or more mitridatites, or any mixture thereof.

5. The method according to any one of paragraphs 1 to 4, wherein the contaminant comprises sand, clay, or a mixture thereof.

6. The method according to any one of paragraphs 1 to 5, wherein the depressant comprises the amine-aldehyde resin.

7. The method according to any one of paragraphs 1 to 6, wherein the depressant comprises the amine-aldehyde resin, wherein the amine-aldehyde resin comprises a guanidine-aldehyde polymer, wherein the dispersant comprises the silicate, wherein the silicate comprises sodium silicate, and wherein the weight ratio of the dispersant to the depressant is from about 9:1 to about 15:1.

8. The method according to any one of paragraphs 1 to 7, wherein the depressant comprises the Maillard reaction product, and wherein the Maillard reaction product is formed by reacting one or more amine reactants and one or more reducing sugars.

9. The method according to any one of paragraphs 1 to 8, further comprising passing air through the treated mixture, wherein a relatively hydrophobic fraction floats to the surface and a relatively hydrophilic fraction sinks to the bottom.

10. The method according to paragraph 0, wherein the purified product is recovered in the hydrophobic fraction.

11. The method according to any one of paragraphs 1 to 10, further comprising treating the aqueous slurry with a collector to produce the treated mixture, wherein the collector comprises fatty acids, an amine, a xanthate, a fuel oil, a fatty acid soap, a nonionic surfactant, an alkyl dithiophosphate, an alkyl thiophosphate, a fatty hydroxamate, an alkyl sulfonate, an alkyl sulfate, an alkyl phosphonate, an alkyl phosphate, an alkyl ether amine, an alkylether diamine, an alkyl amido amine, or any mixture thereof.

12. The method according to any one of paragraphs 1 to 11, wherein the treated mixture comprises about 0.1 kg per tonne solids to about 25 kg per tonne solids of the dispersant, and wherein the treated mixture comprises about 0.05 kg per tonne solids to about 5 kg per tonne solids of the depressant.

13. A method for purifying a value material, comprising: combining a dispersant and a depressant with an aqueous mixture comprising a value material and a contaminant to produce a treated mixture, wherein: a weight ratio of the dispersant to the depressant is from about 1:1 to about 30:1, the dispersant comprises a silicate, and the depressant comprises an amine-aldehyde resin; and passing air through the treated mixture, wherein a relatively hydrophobic fraction floats to the surface and a relatively hydrophilic fraction sinks to the bottom; and recovering a purified product comprising the value material from the relatively hydrophobic fraction or the relatively hydrophilic fraction, wherein the purified product has a reduced concentration of the contaminant relative to the aqueous slurry.

14. The method according to paragraph 13, wherein the amine-aldehyde resin comprises a guanidine-aldehyde polymer.

15. The method according to paragraph 13 or 14, wherein the value material comprises phosphorus, and wherein the contaminant comprises clay, sand, or a mixture thereof.

16. The method according to any one of paragraphs 13 to 15, wherein the amine-aldehyde resin comprises a guanidine-aldehyde polymer, wherein the silicate comprises sodium silicate, and wherein the weight ratio of the dispersant to the depressant is from about 9:1 to about 15:1.

17. The method according to any one of paragraphs 13 to 16, wherein the value material comprises a phosphorus containing ore, and wherein the phosphorus containing ore comprises triphylite, monazite, hinsdalite, pyromorphite, vanadinite, erythrite, amblygonite, lazulite, wavellite, turquoise, autunite, carnotite, phosphophyllite, struvite, one or more apatites, one or more mitridatites, or any mixture thereof, and wherein the contaminant comprises sand, clay, or a mixture thereof.

18. A composition, comprising: a dispersant and a depressant, wherein: a weight ratio of the dispersant to the depressant is from about 1:1 to about 30:1, the dispersant comprises silica, a silicate, a polysiloxane, a starch, a modified starch, a gum, a tannin, a lignosulphonate, carboxyl methyl cellulose, a cyanide salt, a polyacrylic acid based polymer, a naphthalene sulfonate, a benzene sulfonate, a pyrophosphate, a phosphate, a phosphonate, a tannate, a polycarboxylate polymer, a polysaccharide, dextrin, a sulfate, or any mixture thereof, and the depressant comprises an amine-aldehyde resin, an amine-aldehyde resin modified with a silane coupling agent, a Maillard reaction product, a mixture of one or more polysaccharides and one or more resins having azetidinium functional groups, a polysaccharide cross-linked with one or more resins having azetidinium functional groups, or any mixture thereof.

19. The composition according to paragraph 18, wherein the depressant comprises the amine-aldehyde resin, wherein the amine-aldehyde resin comprises a guanidine-aldehyde polymer, wherein the dispersant comprises the silicate, and wherein the silicate comprises sodium silicate.

20. The composition according to paragraph 18 or 19, wherein the depressant comprises the amine-aldehyde resin, wherein the amine-aldehyde resin comprises a guanidine-aldehyde polymer, wherein the dispersant comprises the silicate, wherein the silicate comprises sodium silicate, and wherein the weight ratio of the dispersant to the depressant is from about 9:1 to about 15:1.

21. A method for removing contaminants from an aqueous slurry, comprising: treating an aqueous mixture comprising a value material and a contaminant with a dispersant and a depressant to produce a treated mixture, wherein: the dispersant is selected from the group consisting of: silica, silicates, polysiloxanes, starches, modified starches, gums, tannins, lignosulphonates, carboxyl methyl cellulose, cyanide salts, polyacrylic acid based polymers, naphthalene sulfonates, benzene sulfonates, pyrophosphates, phosphates, phosphonates, tannates, polycarboxylate polymers, polysaccharides, dextrin, sulfates, or any mixture thereof, and the depressant is selected from the group consisting of: one or more amine-aldehyde resins, one or more modified amine-aldehyde resins, one or more Maillard reaction products, a mixture of one or more polysaccharides and one or more resins having azetidinium functional groups; one or more polysaccharides cross-linked with one or more resins having azetidinium functional groups; or any mixture thereof; and recovering from the treated mixture a purified product comprising the value material and having a reduced concentration of the contaminant relative to the aqueous slurry.

22. The method according to paragraph 21, wherein a weight ratio of the dispersant to the depressant is from about 1:1 to about 30:1.

23. The method according to paragraph 21 or 22, wherein the value material comprises phosphorus, lime, sulfates, gypsum, iron, platinum, gold, palladium, cobalt, barium, antimony, bismuth, titanium, molybdenum, copper, uranium, chromium, tungsten, manganese, magnesium, lead, zinc, rare earth elements, clay, coal, silver, graphite, nickel, bauxite, borax, borate, carbonates, a heavy hydrocarbon, or any mixture thereof.

24. The method according to paragraph 23, wherein the phosphorus is present and is in the form of one or more phosphorus containing ores.

25. The method according to any one of paragraphs 21 to 24, wherein the value material comprises one or more phosphorus containing ores.

26. The method according to paragraph 25, wherein the one or more phosphorus containing ores is selected from the group consisting of: triphylite, monazite, hinsdalite, pyromorphite, vanadinite, erythrite, amblygonite, lazulite, wavellite, turquoise, autunite, carnotite, phosphophyllite, struvite, one or more apatites, one or more mitridatites, or any mixture thereof.

27. The method according to any one of paragraphs 21 to 26, wherein a weight ratio of the dispersant to the depressant is from about 1:1 to about 20:1.

28. The method according to any one of paragraphs 21 to 27, wherein the contaminant comprises silica, one or more siliceous materials, one or more silicates, halite, clay, one or more carbonate materials insoluble in water, anhydrite, one or more metal oxides, metal sulfides, metal sulfates, metal arsenates, or any mixture thereof.

29. The method according to any one of paragraphs 21 to 28, wherein the contaminant comprises one or more siliceous materials.

30. The method according to any one of paragraphs 21 to 29, wherein the contaminant comprises sand, clay, or a mixture thereof.

31. The method according to any one of paragraphs 21 to 30, wherein the one or more amine-aldehyde resins is present.

32. The method according to any one of paragraphs 21 to 31, wherein the one or more amine-aldehyde resins is present and comprises a guanidine polymer.

33. The method according to any one of paragraphs 21 to 32, wherein the one or more amine aldehyde resins is present and comprises a polymer formed by reacting a monomer mixture comprising one or more aldehydes and a sufficient amount of guanidine to provide a net cationic charge.

34. The method according to any one of paragraphs 21 to 33, wherein the monomer mixture further comprises one or more aldehyde reactive compounds.

35. The method according to paragraph 34, wherein the one or more aldehyde reactive compounds comprises urea.

36. The method according to paragraph 34, wherein the one or more aldehyde reactive compounds is selected from the group consisting of: ammonia, primary amines, secondary amines, phenolic compounds, and mixtures thereof.

37. The method according to any one of paragraphs 21 to 36, wherein the one or more modified amine-aldehyde resins is present.

38. The method according to paragraph 37, wherein the one or more modified amine-aldehyde resins comprises an amine-aldehyde resin modified with a coupling agent.

39. The method according to paragraph 38, wherein the coupling agent is a silane coupling agent.

40. The method according to any one of paragraphs 21 to 39, wherein the one or more Maillard reaction products is present.

41. The method according to paragraph 40, wherein the one or more Maillard reaction products is formed by reacting one or more amine reactants and one or more reducing sugars, one or more reducing sugar equivalents, or a mixture thereof.

42. The method according to any one of paragraphs 21 to 41, wherein the mixture of the one or more polysaccharides and one or more resins having azetidinium functional groups is present.

43. The method according to paragraph 42, wherein the one or more polysaccharides comprises starch, guar gum, alginate, or any mixture thereof, and wherein the one or more resins is a reaction product of a polyamidoamine and a halohydrin.

44. The method according to any one of paragraphs 21 to 43, wherein the one or more polysaccharides cross-linked with one or more resins having azetidinium functional groups is present.

45. The method according to any one of paragraphs 21 to 44, further comprising passing air through the dispersed mixture and having a relatively hydrophobic fraction float to the surface and a relatively hydrophilic fraction sink to the bottom.

46. The method according to paragraph 45, wherein the purified product is recovered in the hydrophobic fraction.

47. The method according to paragraph 45, wherein the purified product is recovered in the hydrophilic fraction.

48. The method according to any one of paragraphs 21 to 47, further comprising treating the aqueous slurry with one or more collectors to produce the treated mixture.

49. The method according to paragraph 48, wherein the one or more collectors comprises one or more fatty acids, one or more amines, xanthates, one or more fuel oils, fatty acid soaps, nonionic surfactants, crude tall oil, oleic acid, tall oil fatty acids, saponified natural oils, alkyl dithiophosphates, alkyl thiophosphates fatty hydroxamates, alkyl sulfonates, alkyl sulfates, alkyl phosphonates, alkyl phosphates, alkyl ether amines, alkylether diamines, alkyl amido amines, or any mixture thereof.

50. The method according to any one of paragraphs 21 to 49, wherein the dispersant is present in the treated mixture in an amount from about 0.1 kg per tonne solids to about 25 kg per tonne solids, and wherein the depressant is present in the treated mixture in an amount from about 0.05 kg per tonne solids to about 5 kg per tonne solids.

51. A composition, comprising: a dispersant comprising a silicate and a depressant comprising a polymer, wherein the polymer is formed by reacting a monomer mixture comprising one or more aldehydes and a sufficient amount of guanidine to provide a net cationic charge, and wherein a weight ratio of the dispersant to the depressant is from about 1:1 to about 30:1.

52. The composition according to paragraph 51, wherein the silicate comprises sodium silicate.

53. The composition according to paragraph 51 or 52, wherein the monomer mixture further comprises one or more aldehyde reactive compounds.

54. The method according to paragraph 53, wherein the one or more aldehyde reactive compounds comprises urea.

55. The method according to paragraph 53, wherein the one or more aldehyde reactive compounds is selected from the group consisting of: ammonia, primary amines, secondary amines, phenolic compounds, and mixtures thereof.

56. The composition according to any one of paragraphs 51 to 55, wherein a weight ratio of the dispersant to the depressant is from about 1:1 to about 25:1.

57. The composition according to any one of paragraphs 51 to 55, wherein a weight ratio of the dispersant to the depressant is from about 9:1 to about 15:1.

58. A composition for purifying an aqueous slurry comprising an ore and a contaminant, the composition, comprising: a dispersant selected from the group consisting of: silica, silicates, polysiloxanes, starches, modified starches, gums, tannins, lignosulphonates, carboxyl methyl cellulose, cyanide salts, polyacrylic acid based polymers, naphthalene sulfonates, benzene sulfonates, pyrophosphates, phosphates, phosphonates, tannate, polycarboxylate polymers, polysaccharides, dextrin, sulfates, or any mixture thereof, and a depressant selected from the group consisting of: one or more amine-aldehyde resins, one or more modified amine-aldehyde resins, one or more Maillard reaction products, a mixture of one or more polysaccharides and one or more resins having azetidinium functional groups; one or more polysaccharides cross-linked with one or more resins having azetidinium functional groups; or any mixture thereof.

59. The composition according to paragraph 58, wherein the one or more amine-aldehyde resins is present and comprises a polymer formed by reacting a monomer mixture comprising one or more aldehydes and a sufficient amount of guanidine to provide a net cationic charge.

60. The composition according to paragraph 59, wherein the monomer mixture further comprises one or more aldehyde reactive compounds.

61. The composition according to paragraph 60, wherein the one or more aldehyde reactive compounds comprises urea.

62. The composition according to paragraph 60, wherein the one or more aldehyde reactive compounds is selected from the group consisting of: ammonia, primary amines, secondary amines, phenolic compounds, and mixtures thereof.

63. A froth flotation method for removing solid contaminants from an aqueous slurry, comprising: dispersing a dispersant and a depressant in an aqueous slurry comprising at least one contaminant and at least one value material to provide a dispersed mixture, wherein: the dispersant is selected from the group consisting of: silica, silicates, polysiloxanes, starches, modified starches, gums, tannins, lignosulphonates, carboxyl methyl cellulose, cyanide salts, polyacrylic acid based polymers, naphthalene sulfonates, benzene sulfonates, pyrophosphates, phosphates, phosphonates, tannate, polycarboxylate polymers, polysaccharides, dextrin, sulfates, or any mixture thereof, and the depressant is selected from the group consisting of: one or more amine-aldehyde resins, one or more modified amine-aldehyde resins, one or more Maillard reaction products, a mixture of one or more polysaccharides and one or more resins having azetidinium functional groups; one or more polysaccharides cross-linked with one or more resins having azetidinium functional groups; or any mixture thereof; passing air through the dispersed mixture to provide a relatively hydrophobic fraction and a relatively hydrophilic fraction; and collecting a purified product comprising the value material having a reduced concentration of the contaminant relative to the aqueous slurry from either fraction.

64. The method according to paragraph 63, wherein the purified product is recovered from the hydrophilic fraction.

65. The method according to paragraph 63, wherein the purified product is recovered from the hydrophobic fraction.

66. The method according to any one of paragraphs 63 to 65, wherein the value material comprises phosphorus, lime, sulfates, gypsum, iron, platinum, gold, palladium, cobalt, barium, antimony, bismuth, titanium, molybdenum, copper, uranium, chromium, tungsten, manganese, magnesium, lead, zinc, rare earth elements, clay, coal, silver, graphite, nickel, bauxite, borax, borate, carbonates, a heavy hydrocarbon, or any mixture thereof.

67. The method according to any one of paragraphs 63 to 66, wherein the contaminant comprises silica, one or more siliceous materials, one or more silicates, halite, clay, one or more carbonate materials insoluble in water, anhydrite, one or more metal oxides, metal sulfides, metal sulfates, metal arsenates, or any mixture thereof.

68. A froth flotation method for removing solid contaminants from an aqueous slurry, comprising: treating an aqueous slurry comprising at least one contaminant with dispersant, a depressant, and a collector to provide a treated mixture, wherein: the dispersant is selected from the group consisting of: silica, silicates, polysiloxanes, starches, modified starches, gums, tannins, lignosulphonates, carboxyl methyl cellulose, cyanide salts, polyacrylic acid based polymers, naphthalene sulfonates, benzene sulfonates, pyrophosphates, phosphates, phosphonates, tannate, polycarboxylate polymers, polysaccharides, dextrin, sulfates, or any mixture thereof, and the depressant is selected from the group consisting of: one or more amine-aldehyde resins, one or more modified amine-aldehyde resins, one or more Maillard reaction products, a mixture of one or more polysaccharides and one or more resins having azetidinium functional groups; one or more polysaccharides cross-linked with one or more resins having azetidinium functional groups; or any mixture thereof; passing air through the dispersed mixture to provide a relatively hydrophobic fraction and a relatively hydrophilic fraction; and recovering from the treated mixture a purified product having a reduced concentration of the contaminant relative to the aqueous slurry.

69. The method according to paragraph 68, wherein the one or more value materials comprises phosphorus, lime, sulfates, gypsum, iron, platinum, gold, palladium, cobalt, barium, antimony, bismuth, titanium, molybdenum, copper, uranium, chromium, tungsten, manganese, magnesium, lead, zinc, rare earth elements, clay, coal, silver, graphite, nickel, bauxite, borax, borate, carbonates, a heavy hydrocarbon, or any mixture thereof.

70. The method according to paragraph 68 or 69, wherein the one or more contaminants comprises silica, one or more siliceous materials, one or more silicates, halite, clay, one or more carbonate materials insoluble in water, anhydrite, one or more metal oxides, metal sulfides, metal sulfates, metal arsenates, or any mixture thereof.

71. The method according to any one of paragraphs 68 to 70, wherein the purified product is recovered from the hydrophilic fraction.

72. The method according to any one of paragraphs 68 to 70, wherein the purified product is recovered from the hydrophobic fraction.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for purifying a value material, comprising:
contacting an aqueous mixture comprising a phosphorus containing ore and a contaminant comprising sand, clay, or a mixture thereof with a dispersant and a depressant to produce a treated mixture, wherein:
an amount of the dispersant in the treated mixture is from about 1.5 kg/tonne of solids in the treated mixture to about 15 kg/tonne of solids in the treated mixture,
a weight ratio of the dispersant to the depressant is from about 1:1 to about 30:1,
the dispersant comprises a silicate, and
the depressant comprises a cationic guanidine-aldehyde polymer; and
recovering a purified phosphorous containing ore product from the treated mixture, wherein the purified phosphorous containing ore product has a reduced concentration of the contaminant relative to the aqueous slurry.

2. The method of claim 1, wherein the weight ratio of the dispersant to the depressant is from about 9:1 to about 15:1.

3. The method of claim 1, wherein the amount of the dispersant in the treated mixture is from about 2 kg/tonne of solids in the treated mixture to about 6 kg/tonne of solids in the treated mixture.

4. The method of claim 1, wherein the phosphorus containing ore comprises triphylite, monazite, hinsdalite, pyromorphite, vanadinite, erythrite, amblygonite, lazulite, wavellite, turquoise, autunite, carnotite, phosphophyllite, struvite, one or more apatites, one or more mitridatites, or any mixture thereof.

5. The method of claim 1, wherein the contaminant comprises clay.

6. The method of claim 1, wherein:
the weight ratio of the dispersant to the depressant is from about 10:1 to about 15:1,
the dispersant comprises sodium silicate, and
the cationic guanidine-aldehyde polymer comprises a cationic guanidine-formaldehyde polymer.

7. The method of claim 1, wherein:
the cationic guanidine-aldehyde polymer comprises a cationic guanidine-formaldehyde polymer,
the dispersant comprises sodium silicate,
the weight ratio of the dispersant to the depressant is from about 9:1 to about 15:1,
a pH of the treated mixture is about 10 to about 12, and the amount of the dispersant in the treated mixture is from about 2 kg/tonne of solids in the treated mixture to about 6 kg/tonne of solids in the treated mixture.

8. The method of claim 7, wherein:

the dispersant is added to the aqueous mixture to produce a first mixture, the depressant is added to the first mixture to produce the treated mixture, and the first mixture is agitated for about 30 seconds to about 24 hours prior to adding the depressant.

9. The method of claim 1, further comprising passing air through the treated mixture, wherein a relatively hydrophobic fraction floats to the surface and a relatively hydrophilic fraction sinks to the bottom.

10. The method of claim 9, wherein the purified phosphorus containing ore product is recovered in the hydrophobic fraction.

11. The method of claim 1, further comprising treating the aqueous slurry with a collector to produce the treated mixture, wherein the collector comprises fatty acids, an amine, a xanthate, a fuel oil, a fatty acid soap, a nonionic surfactant, an alkyl dithiophosphate, an alkyl thiophosphate, a fatty hydroxamate, an alkyl sulfonate, an alkyl sulfate, an alkyl phosphonate, an alkyl phosphate, an alkyl ether amine, an alkylether diamine, an alkyl amido amine, or any mixture thereof.

12. The method of claim 1, wherein the amount of the dispersant in the treated mixture is from about 3 kg per tonne of solids in the treated mixture to about 6 kg per tonne of solids in the treated mixture, and wherein the dispersant comprises sodium silicate.

13. The method of claim 1, wherein the guanidine-aldehyde polymer is produced by reacting a monomer mixture comprising formaldehyde and a guanidine salt, and wherein the guanidine salt comprises guanidine carbonate, guanidine chloride, guanidine nitrate, or any mixture thereof.

14. A method for purifying a value material, comprising:

combining a dispersant and a depressant with an aqueous mixture comprising a phosphorus containing ore and a contaminant comprising sand, clay, or a mixture thereof to produce a treated mixture, wherein:

an amount of the dispersant in the treated mixture is from about 1.5 kg/tonne of solids in the treated mixture to about 7 kg/tonne of solids in the treated mixture, a weight ratio of the dispersant to the depressant is from about 1:1 to about 20:1, the dispersant comprises sodium silicate, the depressant comprises a cationic guanidine-formaldehyde polymer, and a pH of the treated mixture is about 10 to about 12; and passing air through the treated mixture, wherein a relatively hydrophobic fraction floats to the surface and a relatively hydrophilic fraction sinks to the bottom; and recovering a purified phosphorus containing ore product from the relatively hydrophobic fraction, wherein the purified phosphorus containing ore product has a reduced concentration of the contaminant relative to the aqueous slurry.

15. The method of claim 14, wherein the cationic guanidine-formaldehyde polymer is produced by reacting a monomer mixture comprising formaldehyde and a guanidine salt, and wherein the guanidine salt comprises guanidine carbonate, guanidine chloride, guanidine nitrate, or any mixture thereof.

16. The method of claim 14, wherein the contaminant comprises clay.

17. The method of claim 14, wherein the weight ratio of the dispersant to the depressant is from about 9:1 to about 15:1.

18. The method of claim 17, wherein the phosphorus containing ore comprises triphylite, monazite, hinsdalite, pyromorphite, vanadinite, erythrite, amblygonite, lazulite, wavellite, turquoise, autunite, carnotite, phosphophyllite, struvite, one or more apatites, one or more mitridatites, or any mixture thereof.

19. A method for purifying a value material, comprising:

adding sodium silicate to an aqueous mixture comprising a phosphorus containing ore and a contaminant comprising sand, clay, or a mixture thereof to produce a first mixture;

adding a cationic guanidine-formaldehyde polymer to the first mixture to produce a treated mixture, wherein:

the first mixture is agitated for about 30 seconds to about 24 hours prior to adding the cationic guanidine-formaldehyde polymer, an amount of the sodium silicate in the treated mixture is from about 1.5 kg/tonne of solids in the treated mixture to about 7 kg/tonne of solids in the treated mixture, a weight ratio of the sodium silicate to the cationic guanidine-formaldehyde polymer is from about 10:1 to about 20:1, and a pH of the treated mixture is about 10 to about 12;

passing air through the treated mixture, wherein a relatively hydrophobic fraction floats to the surface and a relatively hydrophilic fraction sinks to the bottom; and recovering a purified phosphorus containing ore product from the relatively hydrophobic fraction, wherein the purified phosphorus containing ore product has a reduced concentration of the contaminant relative to the aqueous slurry.

20. The method of claim 19, wherein the weight ratio of the sodium silicate to the cationic guanidine-formaldehyde polymer is from about 10:1 to about 15:1, and wherein the amount of the sodium silicate in the treated mixture is from about 1.5 kg/tonne of solids in the treated mixture to about 5 kg/tonne of solids in the treated mixture.

* * * * *